US008393561B2

(12) United States Patent
Bjornson et al.

(10) Patent No.: US 8,393,561 B2
(45) Date of Patent: Mar. 12, 2013

(54) METHOD AND APPARATUS FOR CREATING A SLURRY

(75) Inventors: Bradford E. Bjornson, Lethbridge (CA); Garth Robert Booker, Fort McMurray (CA)

(73) Assignee: Suncor Energy Inc., Calgary Alberta (CA)

( * ) Notice: Subject to any disclaimer, the term of this patent is extended or adjusted under 35 U.S.C. 154(b) by 1254 days.

(21) Appl. No.: 11/938,175

(22) Filed: Nov. 9, 2007

(65) Prior Publication Data

US 2008/0173572 A1 Jul. 24, 2008

Related U.S. Application Data

(63) Continuation-in-part of application No. 11/558,303, filed on Nov. 9, 2006, now Pat. No. 7,651,042.

(30) Foreign Application Priority Data

Nov. 9, 2005 (CA) ..... 2526336
Nov. 9, 2006 (CA) ..... 2567643

(51) Int. Cl.
*B02C 4/12* (2006.01)

(52) U.S. Cl. ..... 241/62; 241/81; 241/86; 241/95; 241/100

(58) Field of Classification Search ..... 241/81, 241/100, 189.1, 95, 86, 60, 62, 223, 241, 241/241.5, 21

See application file for complete search history.

(56) References Cited

U.S. PATENT DOCUMENTS 183,114 A 10/1876 Blake ..... 241/135
528,974 A 11/1894 Pike
670,312 A 3/1901 Cressonnieres ..... 241/159
1,277,344 A 8/1918 McCargar ..... 241/159
1,930,247 A 10/1933 McCormick ..... 241/17
2,606,861 A 8/1952 Eastwood ..... 208/55
2,661,664 A * 12/1953 Baxter, Jr. ..... 241/73

(Continued)

FOREIGN PATENT DOCUMENTS

CA 841581 5/1970
CA 857305 12/1970

(Continued)

OTHER PUBLICATIONS

Natural Resources Canada, Treatment of Bitumen Froth and Oil Tailings, downloaded from the world wide web at nrcan.gc.ca/es/etb/cwrc/english/ast/researchareas/frothandslop/frothandslop.htm on Dec. 5, 2001.

(Continued)

*Primary Examiner* — Mark Rosenbaum
(74) *Attorney, Agent, or Firm* — Knobbe, Martens, Olson & Bear, LLP

(57) ABSTRACT

A mobile slurry apparatus for creating a slurry from oil sand ore has a frame and a slurry box supported by the frame. Water is mixed with the ore to form a slurry that is retained in the slurry box. The frame base has a first set of spaced apart support points for supporting the frame in a stationary mode, and a second set of spaced apart support points for supporting the frame in a moving mode. The second set of spaced apart support points is closer together than the first set of support points and defines a lifting region disposed beneath a center of gravity of the slurry apparatus in a moving mode when the slurry box is empty. Thus, a single moving device can be positioned beneath the second set of support points for lifting and moving the slurry apparatus.

22 Claims, 24 Drawing Sheets

U.S. PATENT DOCUMENTS

| | | | | |
|---|---|---|---|---|
| 2,674,564 | A | 4/1954 | Hermanson | 208/26 |
| 2,894,824 | A | 7/1959 | Lanning | 422/137 |
| 3,159,562 | A | 12/1964 | Bichard | 208/11 |
| 3,161,483 | A | 12/1964 | Morris | 34/580 |
| 3,260,548 | A | 7/1966 | Reichl | |
| 3,358,855 | A | 12/1967 | Carlton et al. | 214/10 |
| 3,392,105 | A | 7/1968 | Poettmann | 208/11 |
| 3,402,896 | A | 9/1968 | Daman | 241/38 |
| 3,509,641 | A | 5/1970 | Smith et al. | 34/134 |
| 3,524,597 | A | 8/1970 | Burden, Jr. et al. | 241/142 |
| 3,581,875 | A | 6/1971 | Guis | 198/782 |
| 3,808,698 | A | 5/1974 | Peters | 34/33 |
| 3,933,651 | A | 1/1976 | Erskine | 210/400 |
| 3,941,425 | A | 3/1976 | Reichl | 304/14 |
| 3,972,861 | A | 8/1976 | Gardner, Jr. et al. | 260/123.5 |
| 3,998,702 | A | 12/1976 | Opoku | 196/14.52 |
| 4,029,568 | A | 6/1977 | Pittman et al. | 208/11 |
| 4,103,972 | A | 8/1978 | Kochanowsky et al. | 299/18 |
| 4,120,776 | A | 10/1978 | Miller et al. | 208/11 |
| 4,139,646 | A | 2/1979 | Gastrock | 426/430 |
| 4,206,840 | A | 6/1980 | Hanson | 198/301 |
| 4,212,353 | A | 7/1980 | Hall et al. | 166/303 |
| 4,244,165 | A | 1/1981 | McElwain | 56/327.1 |
| 4,297,088 | A | 10/1981 | Akkerman | 417/378 |
| 4,424,113 | A | 1/1984 | Mitchell | 208/11 |
| 4,486,294 | A | 12/1984 | Miller et al. | 208/11 |
| 4,489,818 | A | 12/1984 | Franke et al. | 198/311 |
| 4,505,516 | A | 3/1985 | Shelton | 299/2 |
| 4,505,811 | A | 3/1985 | Griffiths et al. | 209/13 |
| 4,512,956 | A | 4/1985 | Robinson et al. | 422/270 |
| 4,519,899 | A | 5/1985 | Oertle et al. | 208/179 |
| 4,538,734 | A | 9/1985 | Gill | 209/668 |
| 4,549,935 | A | 10/1985 | Tchernyak | 196/14.52 |
| 4,585,180 | A | 4/1986 | Potts | 241/186 |
| 4,658,964 | A | 4/1987 | Williams | 209/552 |
| 4,733,828 | A | 3/1988 | Potts | 241/236 |
| 4,741,444 | A | 5/1988 | Bielagus | 209/672 |
| 4,763,845 | A | 8/1988 | Guggenheimer et al. | 241/101.7 |
| 4,781,331 | A | 11/1988 | Potts | 241/236 |
| 4,795,036 | A | 1/1989 | Williams | 209/667 |
| 4,799,627 | A | 1/1989 | Potts | 241/236 |
| 4,851,123 | A | 7/1989 | Mishra | 210/609 |
| 4,859,317 | A | 8/1989 | Shelfantook et al. | 208/391 |
| 4,994,097 | A | 2/1991 | Brouwers | 55/317 |
| 5,039,227 | A | 8/1991 | Leung et al. | 366/137 |
| 5,117,983 | A | 6/1992 | Marrs | 209/674 |
| 5,124,008 | A | 6/1992 | Rendall et al. | 204/61 |
| 5,143,598 | A | 9/1992 | Graham et al. | 208/390 |
| 5,161,744 | A | 11/1992 | Horst et al. | 241/101.7 |
| 5,186,820 | A | 2/1993 | Schultz et al. | 209/164 |
| 5,242,580 | A | 9/1993 | Sury | 208/400 |
| 5,257,699 | A | 11/1993 | Fricker | 209/672 |
| 5,264,118 | A | 11/1993 | Cymerman et al. | 208/390 |
| 5,316,664 | A | 5/1994 | Gregoli et al. | 208/390 |
| 5,362,000 | A | 11/1994 | Schwelling | 241/159 |
| 5,441,206 | A | 8/1995 | Schade et al. | 241/81 |
| 5,450,966 | A | 9/1995 | Clark et al. | 209/672 |
| 5,480,566 | A | 1/1996 | Strand | 210/772 |
| 5,503,712 | A | 4/1996 | Brown | 162/55 |
| 5,589,599 | A | 12/1996 | McMullen et al. | 585/240 |
| 5,609,307 | A | 3/1997 | Rota | 241/73 |
| 5,645,714 | A | 7/1997 | Strand et al. | 208/391 |
| 5,723,042 | A | 3/1998 | Strand et al. | 208/391 |
| 5,772,127 | A * | 6/1998 | Maciejewski et al. | 241/21 |
| 5,954,277 | A | 9/1999 | Cymerman et al. | 241/21 |
| 5,960,964 | A | 10/1999 | Austin et al. | 209/672 |
| 6,033,187 | A | 3/2000 | Addie | 417/18 |
| 6,065,607 | A | 5/2000 | Magnusson et al. | 209/665 |
| 6,074,549 | A | 6/2000 | Cochrane et al. | 208/391 |
| 6,076,753 | A | 6/2000 | Maciejewski et al. | 241/62 |
| 6,250,476 | B1 | 6/2001 | Kroon et al. | 209/272 |
| 6,283,277 | B1 | 9/2001 | Smith et al. | 198/861.2 |
| 6,318,560 | B2 | 11/2001 | Davis | 209/672 |
| 6,319,099 | B1 | 11/2001 | Akihiro et al. | 451/60 |
| 6,322,327 | B1 | 11/2001 | Dawson et al. | 417/198 |
| 6,322,845 | B1 | 11/2001 | Dunlow | 426/629 |
| 6,325,863 | B1 | 12/2001 | Zamensky et al. | 134/18 |
| 6,371,305 | B1 | 4/2002 | Austin et al. | 209/672 |
| 6,390,915 | B2 | 5/2002 | Brantley et al. | 460/131 |
| 6,450,775 | B1 | 9/2002 | Hutchinson et al. | 417/198 |
| 6,460,706 | B1 | 10/2002 | Davis | 209/672 |
| 6,517,733 | B1 | 2/2003 | Carlson | 210/785 |
| 6,521,079 | B1 | 2/2003 | Roy | 56/345.1 |
| 6,527,960 | B1 | 3/2003 | Bacon et al. | 210/741 |
| 6,585,560 | B2 | 7/2003 | Tanoue et al. | 451/5 |
| 6,648,145 | B2 | 11/2003 | Davis | 209/672 |
| 6,800,116 | B2 | 10/2004 | Stevens et al. | 95/262 |
| 6,818,058 | B2 | 11/2004 | Ronin | 106/705 |
| 6,821,060 | B2 | 11/2004 | McTurk et al. | 406/137 |
| 7,008,966 | B2 | 3/2006 | Degeorge et al. | 518/700 |
| 7,013,937 | B2 | 3/2006 | Potts | 141/387 |
| 816,763 | A1 | 4/2006 | Trask | 241/142 |
| 7,111,738 | B2 | 9/2006 | Allen, III | 209/172 |
| 7,128,375 | B2 | 10/2006 | Watson | 299/8 |
| 7,207,504 | B2 | 4/2007 | Willmot | 241/5 |
| 7,399,406 | B2 | 7/2008 | Mikula et al. | 208/390 |
| 7,556,715 | B2 | 7/2009 | Gaston et al. | 196/14.52 |
| 7,588,206 | B2 | 9/2009 | Hausman et al. | 241/235 |
| 7,677,397 | B2 | 3/2010 | Bjornson et al. | 209/672 |
| 7,893,378 | B2 | 2/2011 | Kenny | 209/576 |
| 2001/0001434 | A1 | 5/2001 | Daigh et al. | 198/301 |
| 2002/0018842 | A1 | 2/2002 | Dunlow | 426/630 |
| 2003/0089644 | A1 | 5/2003 | Hanks | 209/665 |
| 2004/0251731 | A1 | 12/2004 | Potts | 299/18 |
| 2005/0051500 | A1 | 3/2005 | Price et al. | 210/767 |
| 2005/0134102 | A1 | 6/2005 | Cymerman et al. | 299/7 |
| 2005/0161372 | A1 | 7/2005 | Colic | 208/391 |
| 2005/0173726 | A1 | 8/2005 | Potts | 257/134 |
| 2005/0183930 | A1 | 8/2005 | Bernard et al. | 198/508 |
| 2006/0091249 | A1 | 5/2006 | Potts | 241/236 |
| 2006/0226054 | A1 | 10/2006 | Bishop | 209/667 |
| 2007/0014905 | A1 | 1/2007 | Chen et al. | 426/490 |
| 2007/0095032 | A1 | 5/2007 | Nilson | 55/418 |
| 2007/0180741 | A1 | 8/2007 | Bjornson et al. | 37/403 |
| 2007/0180951 | A1 | 8/2007 | Armstrong | 75/367 |
| 2008/0047198 | A1 | 2/2008 | Mehlhose et al. | 48/210 |
| 2008/0121493 | A1 | 5/2008 | Bjornson et al. | 198/301 |
| 2008/0173572 | A1 | 7/2008 | Bjornson et al. | 208/391 |
| 2008/0197056 | A1 | 8/2008 | Kenny | 209/644 |
| 2008/0308133 | A1 | 12/2008 | Grubb et al. | 134/72 |
| 2010/0155305 | A1 | 6/2010 | Bjornson et al. | 208/390 |
| 2010/0181394 | A1 * | 7/2010 | Bruggencate | 241/15 |

FOREIGN PATENT DOCUMENTS

| | | |
|---|---|---|
| CA | 890903 | 1/1972 |
| CA | 2060780 | 8/1972 |
| CA | 917585 | 12/1972 |
| CA | 918588 | 1/1973 |
| CA | 922655 | 3/1973 |
| CA | 997300 | 9/1976 |
| CA | 1068633 | 12/1979 |
| CA | 1085762 | 9/1980 |
| CA | 1088883 | 11/1980 |
| CA | 1103184 | 6/1981 |
| CA | 1106789 | 8/1981 |
| CA | 1117353 | 2/1982 |
| CA | 1126187 | 6/1982 |
| CA | 1132511 | 9/1982 |
| CA | 1137906 | 12/1982 |
| CA | 1153347 | 6/1983 |
| CA | 1163257 | 6/1984 |
| CA | 1193586 | 9/1985 |
| CA | 1214421 | 11/1986 |
| CA | 1231692 | 1/1988 |
| CA | 1256045 | 6/1989 |
| CA | 1266261 | 2/1990 |
| CA | 1267860 | 4/1990 |
| CA | 1269945 | 6/1990 |
| CA | 1277941 | 12/1990 |
| CA | 1309050 | 10/1992 |
| CA | 2116243 | 3/1993 |
| CA | 2000984 | 4/1994 |
| CA | 2088227 | 4/1994 |
| CA | 2092121 | 12/1994 |
| CA | 2029795 | 5/1996 |
| CA | 2105176 | 5/1997 |
| CA | 2164925 | 6/1997 |

| | | | |
|---|---|---|---|
| CA | 2222667 | | 5/1998 |
| CA | 2294860 | | 12/1998 |
| CA | 2217623 | | 4/1999 |
| CA | 2249679 | | 4/1999 |
| CA | 2250623 | | 4/1999 |
| CA | 2220821 | | 5/1999 |
| CA | 2227667 | | 7/1999 |
| CA | 2195604 | | 11/1999 |
| CA | 2246841 | | 3/2000 |
| CA | 2290029 | | 8/2000 |
| CA | 2254048 | | 9/2001 |
| CA | 2358805 | | 10/2001 |
| CA | 2315596 | | 2/2002 |
| CA | 2332207 | | 2/2002 |
| CA | 2431648 | | 6/2002 |
| CA | 2084375 | | 7/2002 |
| CA | 2259245 | | 10/2002 |
| CA | 2352274 | | 1/2003 |
| CA | 2235938 | | 4/2003 |
| CA | 2398026 | | 6/2003 |
| CA | 2440312 | | 9/2003 |
| CA | 2498862 | | 10/2003 |
| CA | 2518040 | | 12/2003 |
| CA | 2436818 | | 2/2004 |
| CA | 2522514 | | 4/2004 |
| CA | 2441969 | | 5/2004 |
| CA | 2469326 | | 5/2004 |
| CA | 2440311 | | 5/2005 |
| CA | 2548370 | | 5/2005 |
| CA | 2548371 | | 5/2005 |
| CA | 2453697 | | 6/2005 |
| CA | 2549895 | | 6/2005 |
| CA | 2554725 | | 6/2005 |
| CA | 2558059 | | 11/2005 |
| CA | 2476194 | | 1/2006 |
| CA | 2480122 | | 3/2006 |
| CA | 2520943 | | 4/2006 |
| CA | 2486137 | | 5/2006 |
| CA | 2506398 | | 5/2006 |
| CA | 2499840 | | 9/2006 |
| CA | 2499846 | | 9/2006 |
| CA | 2552031 | | 1/2007 |
| CA | 2520821 | | 3/2007 |
| CA | 2526336 | | 5/2007 |
| CA | 2567643 | | 5/2007 |
| CA | 2567644 | | 5/2007 |
| CA | 2610124 | | 11/2007 |
| CA | 2610169 | | 11/2007 |
| DE | 2834987 | | 2/1980 |
| DE | 3936681 | | 5/1990 |
| EP | 167178 | | 11/1990 |
| EP | 493858 | B1 | 8/1992 |
| FR | 2185027 | | 12/1973 |
| GB | 1437605 | | 6/1976 |
| GB | 2010777 | | 7/1979 |
| GB | 2094662 | * | 9/1982 |
| GB | 0401933-1 | | 1/2004 |
| GB | 0406802-9 | | 3/2004 |
| JP | 5096492 | | 4/1993 |
| WO | WO 83/00318 | | 2/1983 |
| WO | WO 83/02071 | | 6/1983 |
| WO | WO 83/03062 | | 9/1983 |
| WO | WO 83/03444 | | 10/1983 |
| WO | WO 88/01201 | | 8/1987 |
| WO | WO 96/29149 | | 9/1996 |
| WO | WO 96/30629 | | 10/1996 |
| WO | WO 98/58739 | | 12/1998 |
| WO | WO 99/54049 | | 10/1999 |
| WO | WO00/10896 | | 3/2000 |
| WO | WO00/35585 | | 6/2000 |
| WO | WO02/092231 | | 11/2002 |
| WO | WO03/006165 | | 1/2003 |
| WO | WO03/056134 | | 10/2003 |
| WO | WO 03/074394 | | 12/2003 |
| WO | WO 2004/005673 | | 1/2004 |
| WO | WO 2004/094061 | | 4/2004 |
| WO | WO 2004/060819 | | 7/2004 |
| WO | WO 2005/046874 | | 5/2005 |
| WO | WO 2005/046875 | | 5/2005 |
| WO | WO 2005/000454 | | 6/2005 |
| WO | WO 2005/072877 | | 11/2005 |
| WO | WO 2006/035209 | | 6/2006 |

OTHER PUBLICATIONS

National Energy Board, Canada's Oil Sands: A Supply and Market Outlook to 2015, An Energy Market Assessment Oct. 2000.

Keller, Noble and Caffey "A Unique, Reagent-Based, Separation Method for Tar Sands and Environmental Clean Ups" Presented to AIChE 2001 Annual Meeting Nov. 6, 2001 Reno, Nevada.

The Fine Tailings Fundamentals Consortium "Advances in Oil Sands Tailings Research" ISBN 0-7732-1691-X Published by Alberta Department of Energy Jun. 1995.

Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd f1 pp. 93-100, Paper delivered on Monday Apr. 5, 1993 at a conference in Alberta, Canada entitled "Oil Sands-Our Petroleum Future".

Protest to CA 2358805 Application filed Apr. 15, 2002, 217 pages.

"Oil Sands, Our Petroleum Future" Conference held at Edmonton Convention Centre, Edmonton, Alberta, Canada Apr. 4-7, 1993.

Harding, J. "Cost-Saving Moves into High Gear" article in *Financial Post*, Apr. 4, 2006.

Excerpts from Information Package for Mobile Crushing Plants (MCP), Krupp Canada, 1177 11 Ave., S.W., Suite #405, Calgary, Alberta, pp. 1-7 published Sep. 2004, Canada, pp. 8-46 published May 2003.

Jonah, Ken; "Syncrude's Mine Production Planning", Mine Planning and Equipment, Singhal (ed), pp. 443-456, © 1988 Balkema, Rotterdam, ISBN 90 8191 8197.

Doucet et al. "Drilling and Blasting in Tarsand", Suncor Oil Sands Group, Nov. 7 and 8, 1985.

De Malherbe, et al. "Synthetic Crude from Oil Sands", VDI-Verlag GmbH, Dusseldorf 1983, vol. 3, No. 8, pp. 20-21.

Coward, Julian, seminar material used as class handout, University of Alberta, Mar. 20, 2000.

Stausz et al, "The Chemistry of Alberta Oil Sands, Bitumens and Heavy Oils —Chapter 4 —Composition and Structure of Alberta Oil Sands and Oil Carbonates", Alberta Energy Research Institue, 2003, pp. 29-67.

Printed publication namely Screen-printed (5 pages) electronic brochure from the website of Roxon Equipment. Date display "Jan. 27, 2004" (brochure screen printed Jan. 27, 2004) along with 23 screen-printed pp. from the world wide web at roxongroup.com archived by the Web Archive (web.archive.org).

Office Action dated Jan. 26, 2007 for U.S. Appl. No. 10/825,230.

Office Action dated Oct. 3, 2007 for U.S. Appl. No. 10/825,230.

Office Action dated Jun. 20, 2008 for U.S. Appl. No. 10/825,230.

Notice of Allowability dated May 8, 2009 for U.S. Appl. No. 10/825,230.

Office Action dated Sep. 27, 2007 for U.S. Appl. No. 11/187,977.

Notice of Allowance dated Jun. 13, 2008 for U.S. Appl. No. 11/187,977.

Office Action dated Jan. 22, 2009 for U.S. Appl. No. 11/187,977.

Restriction Requirement dated Nov. 19, 2010 for U.S. Appl. No. 12/646,842.

Office Action dated Apr. 7, 2011 for U.S. Appl. No. 12/646,842.

Restriction Requirement dated Dec. 12, 2008 for U.S. Appl. No. 11/595,817.

Office Action dated Mar. 2, 2009 for U.S. Appl. No. 11/595,817.

Office Action dated Jul. 21, 2009 for U.S. Appl. No. 11/595,817.

Office Action dated May 23, 2008 for U.S. Appl. No. 11/558,340.

Restriction Requirement dated Dec. 2, 2008 for U.S. Appl. No. 11/558,340.

Office Action dated Apr. 29, 2009 for U.S. Appl. No. 11/558,340.

Office Action dated Aug. 28, 2008 for U.S. Appl. No. 11/558,303—Restriction Requirement.

Office Action dated Nov. 12, 2008 for U.S. Appl. No. 11/558,303.

Notice of Allowance dated Sep. 14, 2009 for U.S. Appl. No. 11/558,303.

Office Action dated Apr. 13, 2007 for CA Patent Application No. 2476194.
Office Action dated Jul. 29, 2008 for CA Patent Application No. 2476194.
Office Action dated Jun. 2, 2009 for CA Patent Application No. 2476194.
Restriction Requirement dated Aug. 4, 2011 for U.S. Appl. No. 12/562,785.
Office Action dated Oct. 21, 2011 for U.S. Appl. No. 12/562,785.
Notice of Allowance dated Nov. 17, 2011 for U.S. Appl. No. 12/646,842.
Office Action dated Mar. 14, 2012 for U.S. Appl. No. 12/562,785.
Notice of Allowance for U.S. Appl. No. 12/562,785, dated Aug. 10, 2012.
Notice of Allowance for U.S. Appl. No. 13/280,101, dated Apr. 20, 2012.

* cited by examiner

METHOD AND APPARATUS FOR CREATING A SLURRY

FIELD OF INVENTION

This invention relates to ore processing. In particular, this invention relates to a method and apparatus for creating a slurry from oil sand.

BACKGROUND OF THE INVENTION

The Northern Alberta Tar Sands are considered to be one of the world's largest remaining repositories of oil. The tar sands are typically composed of about 70 to about 90 percent by weight mineral solids, including sand, silt and clay, about 1 to about 10 percent by weight water, and a bitumen or oil film, that comprises from trace amounts up to as much as 21 percent by weight.

Unlike conventional oil reserves, the bitumen is extremely viscous and difficult to separate from the water and mineral mixture in which it is found. Generally speaking, the process of separating bitumen from the tar sands comprises five broad stages. Initially in the first stage, the oil sand is excavated from its location and passed through a crusher, or "sizer," to break down or comminute the ore into conveyable pieces. The crushed ore is then typically combined with hot process water to aid in liberating the oil. The combined comminuted tar sand and hot water is typically referred to as a "slurry." Other agents, such as chemical aids (for example including caustic, surfactant, pH adjuster, dispersant) may be added to the slurry.

The slurry is passed through a slurry box in which the slurry is allowed to mix and dwell for a period, primarily to ensure a proper suction head and a constant flow of slurry to a slurry pump. The slurry output from the slurry box is pumped through a hydrotransport conduit and preferably transported an appropriate distance to condition the slurry, and is typically passed through an extraction facility for separating the bitumen froth from the slurry. Typically the mineral matter is separated from the slurry using specific gravity separation, such as PSV's (Primary Separation Vessels) and hydrocyclones. After the slurry has been processed to remove the optimal amount of bitumen, the remaining material (commonly referred to as tailings) is typically routed into a tailings deposition site.

It has been recognized that, since the bitumen comprises a relatively small percentage by weight of the ore initially extracted, separation of the mineral content from the ore as soon as possible after excavation would lead to the most efficient and cost effective mining process.

Over the years, a variety of processes have been used to process and transport the ore from the excavation site. Initially, oil sand excavation and transport were completely mechanical via trucks or conveyor belts from the mine face to a large facility for crushing and conditioning the tar sand. As described in Canadian Patent No. 2,029,795, it was determined that it was preferable to crush the ore at a slurry preparation facility located at an intermediate site and combine the ore with hot process water to create a slurry in which could be hydraulically transported by a pipe. This "hydro-transport" process served the dual purpose of efficiently transporting the slurry from a site near the mine face to a more permanent facility and allowing time for the slurry to be sufficiently conditioned on route. Provided the hydro-transport was over a large enough distance that the dwell time in the pipe was sufficiently long, the slurry would arrive at the separation facility already conditioned. Thus, the previously required separate conditioning step could be omitted from the process.

While hydro-transport solved some of the difficulties with transporting the ore from the mine site face to the separation facility, it did not address the fact that in open pit mining the mine site face moves as ore is excavated, increasing the distance to the slurry facility. Solutions to date have typically relied on constructing longer conveyor belts to transport the ore, or use additional trucks, to move the ore from the mine face to the slurry facility at the intermediate site.

Prior art slurry facilities are stationed in a fixed location. There thus exists a need to increase the efficiency of excavation and transport processes to reduce operating costs.

It would accordingly be advantageous to provide an apparatus for creating a slurry that is mobile and can be advanced as the distance from the slurry facility to the mine face increases.

BRIEF DESCRIPTION OF THE DRAWINGS

In drawings which illustrate by way of example only a preferred embodiment of the invention.

DETAILED DESCRIPTION OF THE INVENTION

Figure 1:
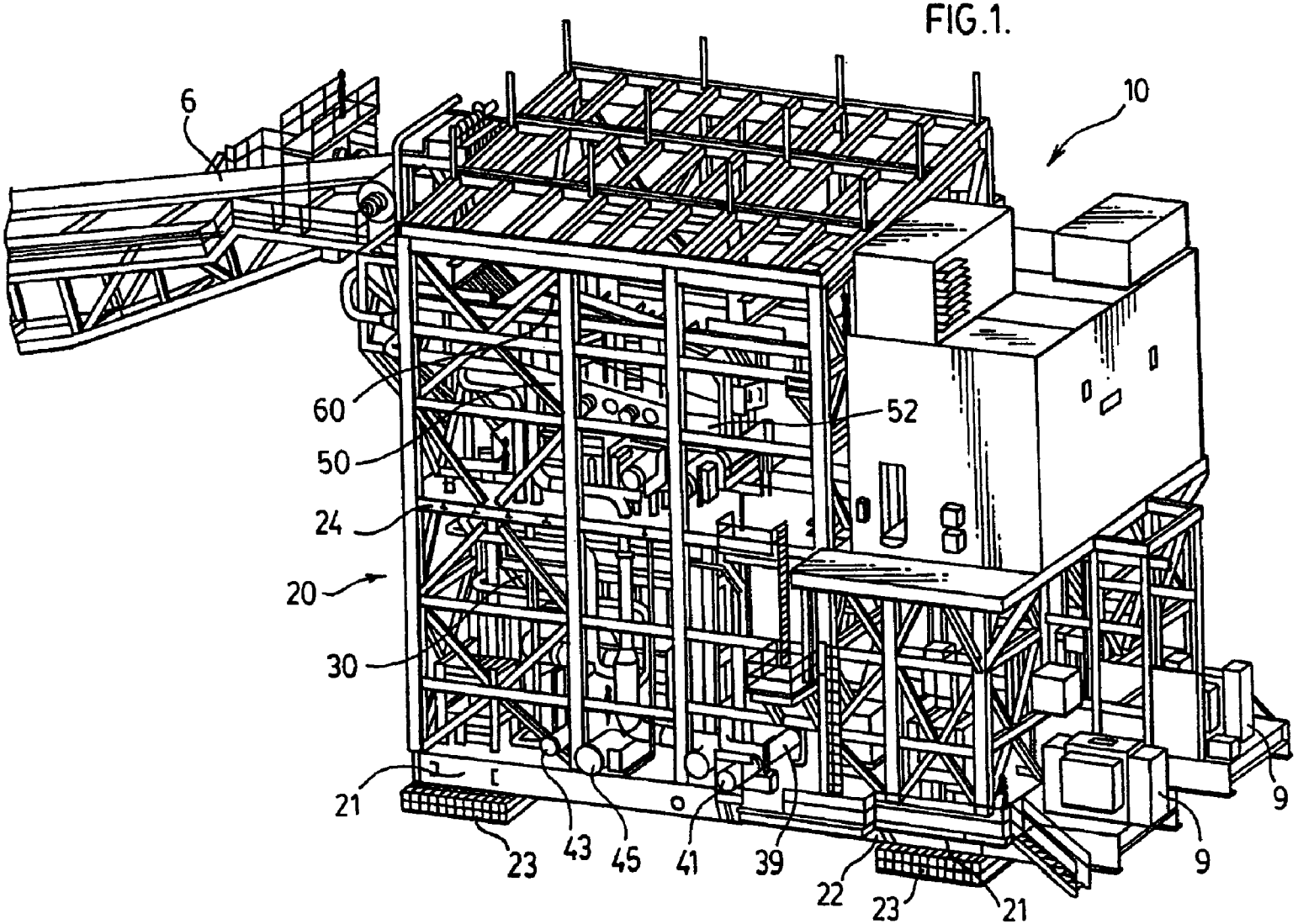
FIG. 1 is a perspective view of a slurry apparatus according to the invention.

In one aspect the invention provides a mobile slurry apparatus for creating a slurry from oil sand ore, comprising a frame, a slurry box supported by the frame, a water supply in communication with the ore or the slurry box, whereby water is mixed with the ore to form a slurry that is retained in the slurry box, the frame comprising a base having a first set of spaced apart support points for supporting the frame in a stationary mode, and a second set of spaced apart support points for supporting the frame in a moving mode, the second set of spaced apart support points being closer together than the first set of support points and defining a lifting region disposed beneath a centre of gravity of the slurry apparatus in a moving mode when the slurry box is empty, whereby a moving device can be positioned beneath the second set of support points for lifting and moving the slurry apparatus.

In a further aspect the invention provides a method of moving from a first site to a second site a slurry facility comprising a comminuting apparatus in communication with a slurry box, whereby comminuted ore is fed to the slurry box, and a frame comprising a base having a first set of spaced apart support points for supporting the frame in a stationary mode and a second set of spaced apart support points for supporting the frame in a moving mode, the second set of spaced apart support points being closer together than the first set of support points, comprising the steps of: a. in any order, i) emptying the slurry box and disconnecting electrical lines and water supplies and a hydrotransport line, and ii) deploying a moving device beneath the base to lift the frame; b. lifting the frame at the second set of support points; c. moving the slurry facility to the second site; d. lowering the slurry facility until it is supported on the first set of support points; and e. reconnecting the electrical lines and water supplies and the hydrotransport line.

In a further aspect the invention provides a slurry apparatus for creating a slurry from oil sand ore, comprising a frame, a slurry box supported by the frame, a water supply in communication with the ore or the slurry box, whereby water is mixed with the ore to form a slurry that is retained in the slurry box, a screen disposed at an angle relative to the horizontal over an open top of the slurry box, and a crusher disposed above the screen, the crusher comprising at least one crushing wheel rotatably mounted a distance from the screen such that the at least one crushing wheel coacts with the screen to size the ore and force the sized ore through the screen.

In a further aspect the invention provides a slurry apparatus for creating a slurry from oil sand ore, comprising a frame, a slurry box supported by the frame, a water supply in communication with the ore or the slurry box, whereby water is mixed with the ore to form a slurry that is retained in the slurry box, at least one sloped screen disposed at an angle relative to the horizontal over an open top of the slurry box, a primary crusher disposed above an upstream end of the sloped screen, and a secondary crusher disposed beneath a downstream end of the sloped screen, whereby the primary crusher sizes the ore and deposits the ore on the sloped screen so that sized ore falls through the screen into the slurry box, and the secondary crusher crushes oversized ore that falls off the downstream end of the sloped screen for deposit into the slurry box.

In a further aspect the invention provides a slurry apparatus for creating a slurry from oil sand ore, comprising a frame, a slurry box supported by the frame, a water supply in communication with the ore or the slurry box, whereby water is mixed with the ore to form a slurry that is retained in the slurry box, and a pump assembly comprising first and second pumps disposed in series, an inlet of the first pump being in communication with an outlet of the slurry box, an outlet of the first pump being in communication with an inlet of the second pump, and an outlet of the second pump being in communication with a slurry outlet for connection to a hydrotransport conduit.

A first embodiment of a slurry apparatus or facility 10 according to the invention is illustrated in FIGS. 1 to 4.

The slurry apparatus 10 provides a frame 20 having a base 22. The frame 20 may optionally also be provided with sides 24. The frame 20 is preferably formed from steel girders or I-beams having the required load-bearing capacity, welded, bolted, or otherwise suitably affixed together. The frame supports a slurry box 30, which may be a conventional slurry box constructed to support the desired slurry load. The slurry box 30 essentially acts as a wet surge, maintaining the required constant supply of slurry to the slurry pump 39. The slurry box 30 provides a slurry box outlet 38 which feeds the slurry pump 39, and the slurry pump 39 in turn provides a hydrotransport outlet 41 to which a hydrotransport conduit (not shown) is detachably coupled by suitable means, for example a bolted flange.

An ore size regulating apparatus such as a screen or comminuting apparatus 50 is suspended above the slurry box 30. For example, in the preferred embodiment the comminuting apparatus may be a screening/sizing roller screen such as that described in Canadian Patent Application No. 2,476,194 entitled "SIZING ROLLER SCREEN ORE PROCESSING" published Jan. 30, 2006, which both screens and crushes ore. In the preferred embodiment the comminuting apparatus 50 is supported on the frame 20 of the slurry apparatus 10, with the output face of the comminuting apparatus 50 in communication with the open top of the slurry box 30 such that comminuted ore fed to the comminuting apparatus 50 is directed into the slurry box 30 under the force of gravity. Alternatively, a screen may be provided to screen the incoming ore flow as an initial step before crushing.

Because the slurry apparatus 10 according to the invention is movable, it is advantageous to maintain a low centre of gravity in the slurry apparatus 10 and therefore if the comminuting apparatus 50 is suspended above the slurry box 30 it is advantageous to provide the comminuting apparatus 50 as close as possible (vertically) to the open top of the slurry box 30. The comminuting apparatus 50 may be oriented close to the horizontal, or alternatively may have either a positive or negative angle relative to the horizontal. In a preferred embodiment the comminuting apparatus 50 is oriented at an angle relative to the horizontal such that comminuted ore is fed at the higher end of the comminuting apparatus 50. The comminuting apparatus 50 may be supported on its own separate frame, may be solely supported by a side 24 of the slurry apparatus frame 20, or may be supported on the slurry box 30. Alternatively, the comminuting apparatus 50 may be in communication with the slurry box 30 via one or more interposed conveyor mechanisms, such as a transfer conveyor (not shown).

The comminuting apparatus 50 may alternatively be housed in a separate structure and maintained in communication with the slurry box 30 by a conveying apparatus such as a transfer conveyor (not shown). Similarly, while the illustrated embodiment shows the slurry pump 39 and electrical transformers 9 housed in the structure of the slurry facility 10, it is possible to house these components in one or more separate structures that are detachably connected to the relevant systems in the slurry facility 10 when the slurry facility 10 is in operating mode. It is advantageous to provide transformers 9 within or immediately adjacent to the slurry facility 10, which will gradually be moved away from any permanent transformer substation as mining progresses.

A water supply 60, for example a hood with a spray header (shown in FIG. 5), is positioned to apply hot process water to the ore as it is fed into the comminuting apparatus 50, assisting in the comminuting process and so that ore is already wetted when it enters slurry box 30. As is well known in the art, the hot process water is mixed with the ore in a proportion which provides the desired slurry consistency for conditioning during transport to an extraction facility. The water supply 60 may be provided in any convenient location for dispensing the process water over the ore, preferably before comminution or optionally after comminution.

The slurry box 30 is mounted to the base 22 of the slurry apparatus frame 20 in the desired position. As illustrated in FIG. 2, the frame 20 is supported on a first set of spaced apart support points 21, for example adjacent to the corners where the sides 24 meet the base 22, which may be mounted on crane mats 23 as in the embodiment illustrated in FIGS. 1 and 2, to support the frame 20 in stationary mode, or alternatively may be mounted on pontoons 27 as in the embodiment illustrated in FIGS. 5 and 6. The slurry box 30 may be disposed anywhere within the frame 20, as long as the centre of gravity CG1 of the slurry apparatus 10 when the slurry box 30 is filled is within the area bounded by the first set of spaced apart support points 21 (as shown in FIG. 2).

The pontoons 27 provide the additional advantage that they can be used to lower the centre of gravity of the facility 10. The pontoons 27 when attached to the base 22 of the frame 20 add weight beneath the level of the base 22, helping to balance the facility 10 both by lowering the centre of gravity and by providing a significant weight below the support point (lifting region 70 of the floor) to serve as a counterbalance to assist with stability. The pontoons 27 can be formed as a weight-bearing structure, such as a steel frame, and blocks or other massive materials can be used to add weight to the pontoons in order to enhance these effects. Preferably if formed as a frame, a covering may be provided to protect the frame. The pontoons 27 also add a safety feature, in that they can be very close to the ground during transport and will contact the ground if the facility 10 tilts even slightly while in motion, forming a support point.

The frame 20 further contains other apparatus incidental to the operation of the slurry facility, which may for example include a gland water supply for the slurry pump 39, cooling units for conditioning the air within the facility 10 to make it suitable for workers, electrical transformers for powering the equipment used in the slurry facility 10, safety equipment, overhead cranes for maintenance and so on. The distribution of equipment about the frame 20 of the slurry apparatus 10 determines a first center of gravity CG1 for the slurry apparatus 10 in a stationary mode, in which the slurry box 30 is filled and operational. Preferably the amount and size of equipment are minimized to keep the weight of the facility 10 as low as possible; for example, the facility 10 may house a single hydrotransport pump 39 (or the hydrotransport pump 39 may be supported on a separate structure as noted above).

Figure 11A:
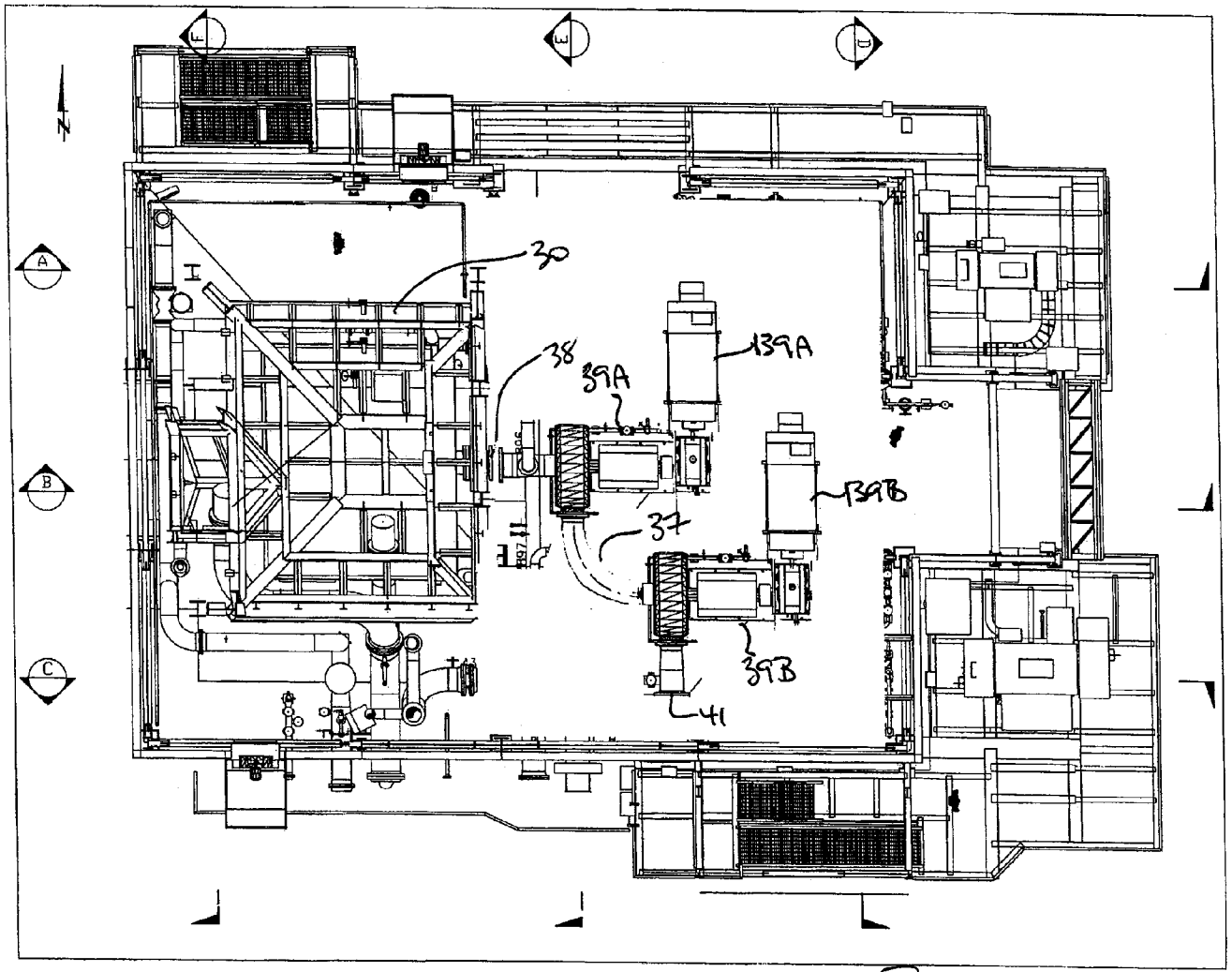
FIGS. 11A to 11C are schematic top plan views of alternate pump arrangements using a dual-pump configuration.
Figure 11B:
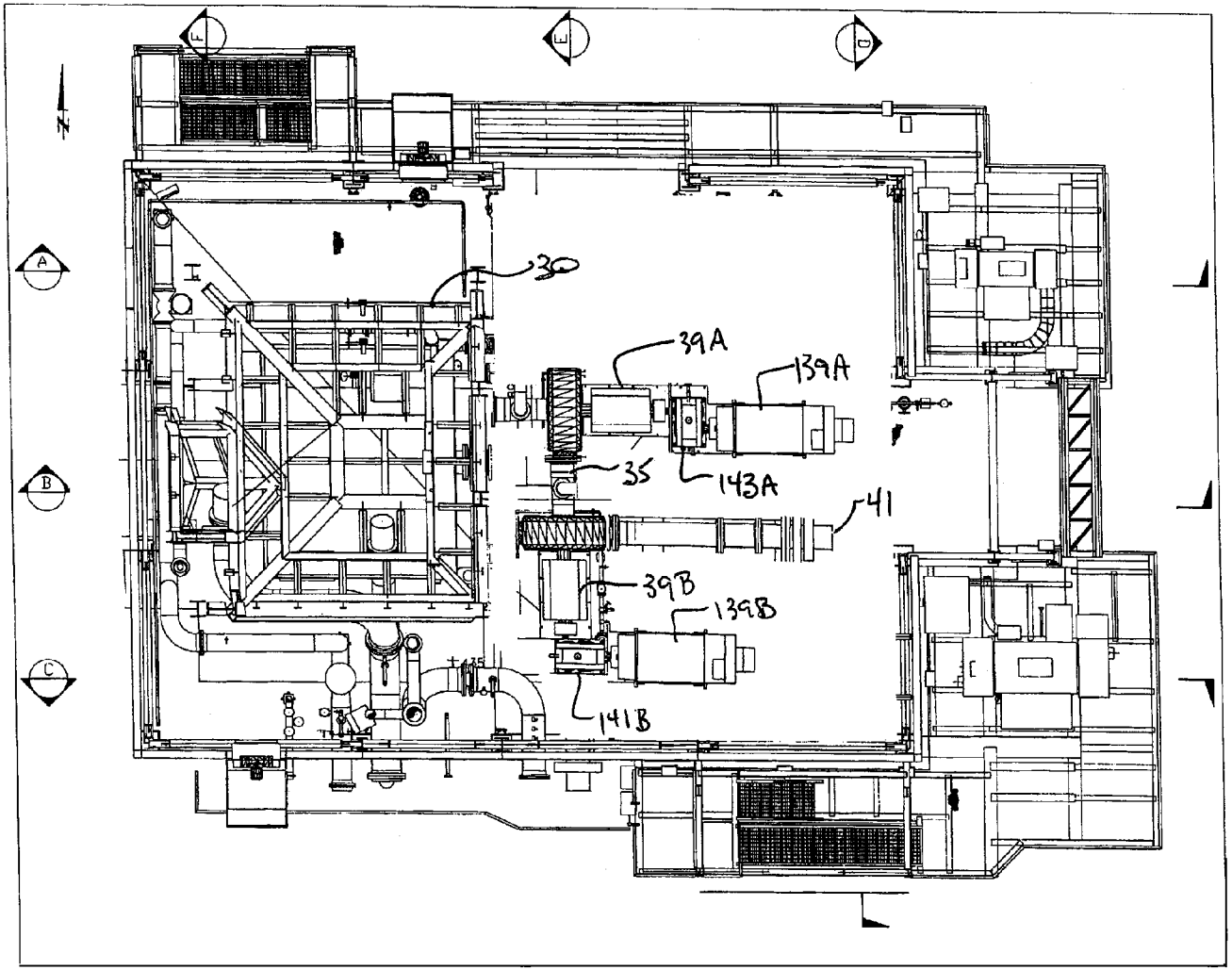
Figure 11C:
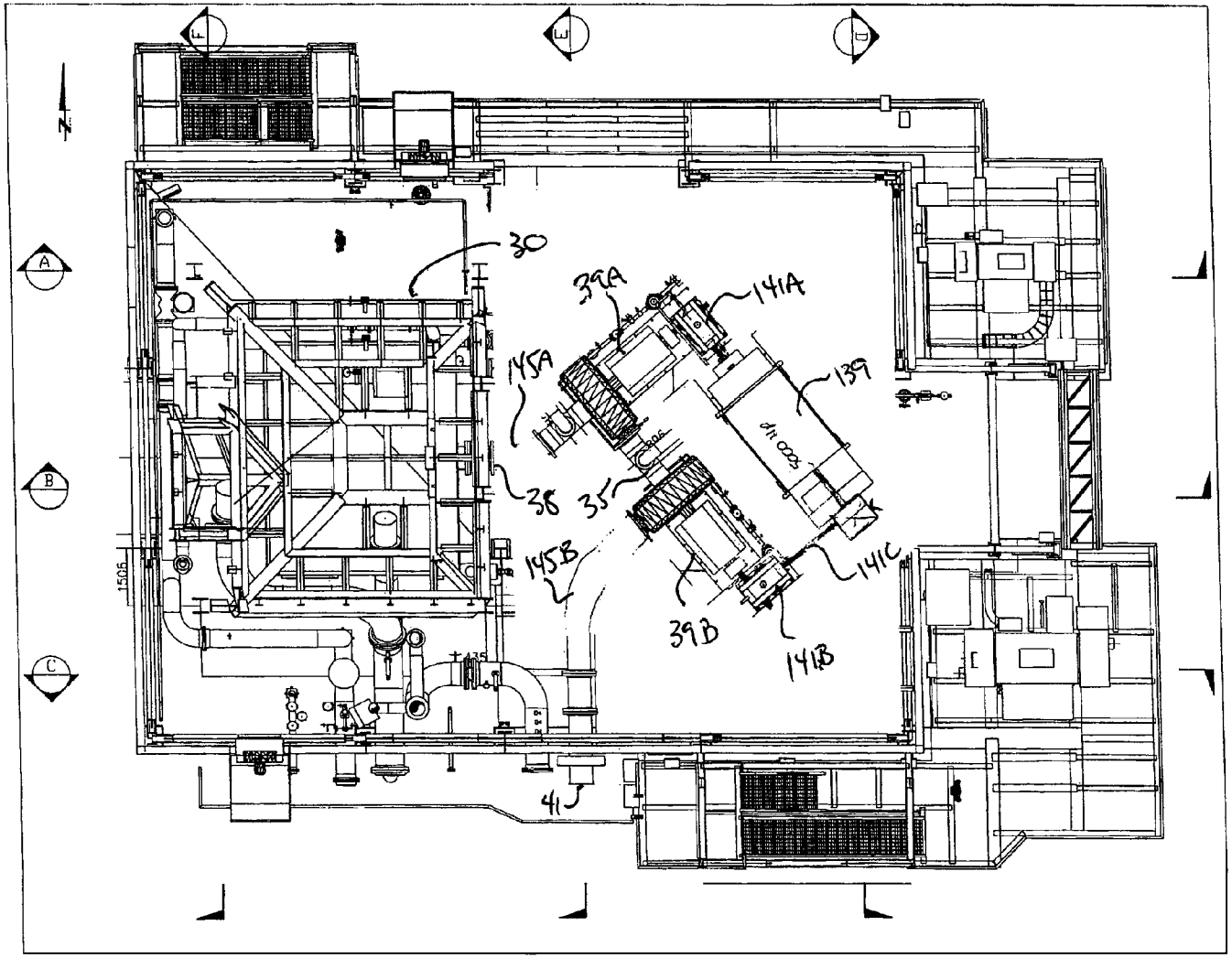

FIGS. 11A to 11C show a dual pump configuration of the slurry apparatus 10. In these embodiments two pumps 39A, 39B operate in series, both controlled by a single control system. This arrangement provides a higher head, resulting in greater pressure in the pipeline which allows the slurry apparatus 10 to pump the slurry further through the hydrotransport conduits without the need for costly booster pumps and mobile booster stations.

In the embodiment illustrated in FIG. 11A pumps 39A, 39B are each respectively driven by motors 139A, 139B respectively disposed at generally right angles to the pumps 39A, 39B via angle gearboxes 141A, 141B, allowing the pumps 39A, 39B to be disposed in a "nested" configuration. The inlet of pump 39A is in communication with slurry box outlet 38, and the outlet of pump 39A is in communication with the inlet of pump 39B via elbow 37, and the outlet of pump 39B is in communication with the hydrotransport outlet 41 for connection to the hydrotransport conduit (not shown).

In the embodiment illustrated in FIG. 11B pumps 39A, 39B are each respectively driven by motors 139A, 139B. Motor 139A is disposed in line with pump 39A via linear gearbox 143A, while motor 139B is disposed at generally a right angle to pump 39B via angle gearbox 141B. The inlet of pump 39A is in communication with slurry box outlet 38. The outlet of pump 39A is in communication with the inlet of pump 39B via coupling 35, and the outlet of pump 39B is in communication with hydrotransport outlet 41 for connection to the hydrotransport conduit (not shown) which, in this embodiment, enters the apparatus 10 from a different angle (the right side of the frame as illustrated in FIG. 11B).

In the embodiment illustrated in FIG. 11C a single motor 139 drives both pumps 39A, 39B via angle gearboxes 141A, 141B. The motor 139 has a shaft extending out of both ends of the motor 139, a first end of which drives gearbox 141A and a second end of which drives gearbox 141B through connecting shaft 141C. This configuration also allows the pumping equipment to fit into a smaller space within the slurry apparatus 10. In the embodiment shown the entire hydrotransport pump assembly is disposed at an oblique angle relative to the slurry box outlet 38. The inlet of pump 39A is in communication with slurry box outlet 38 via elbow 145A. The outlet of pump 39A is in communication with the inlet of pump 39B via coupling 35, and the outlet of pump 39B is in communication with hydrotransport outlet 41 via elbow 145B for connection to the hydrotransport conduit (not shown).

The heaviest equipment should be as low as possible within the frame 20, to keep the centre of gravity CG1 and CG2 low. In the stationary mode, when the frame 20 is supported on the first set of spaced apart support points 21 and the slurry box 30 is filled with slurry and operational, a considerable additional amount of weight is concentrated in the region of the slurry box 30, which determines the position of the first center of gravity CG1. The frame 20 thus supports all the on-board equipment, plus the weight of the slurry, on the first set of spaced apart support points 21.

In a moving mode, with the slurry box 30 empty, the centre of gravity is disposed at CG2. The base 22 of the frame 20 is provided with a lifting region 70, shown in FIG. 3, which is formed by a series of beams affixed to the main girders 28 of the base 22. The entire slurry apparatus 10 can thus be lifted by a single moving device such as a mobile crawler 80, for example that produced by Lampson International LLC (hereinafter referred to as a "Lampson Crawler"), lifting solely at the lifting region 70, without substantial deformation of the frame 20. The lifting region 70 defines a second set of spaced apart support points 72, which is directly beneath (and preferably centered under) the second center of gravity CG2. The Lampson Crawler, which is essentially a hydraulic lifting platform having a propulsion system and mounted on tracks as illustrated in FIG. 9B, can be positioned under the lifting region 70 using locator tabs 74, shown in FIG. 3, and raised to lift the frame 20 while maintaining the stability of the facility 10.

Figure 2:
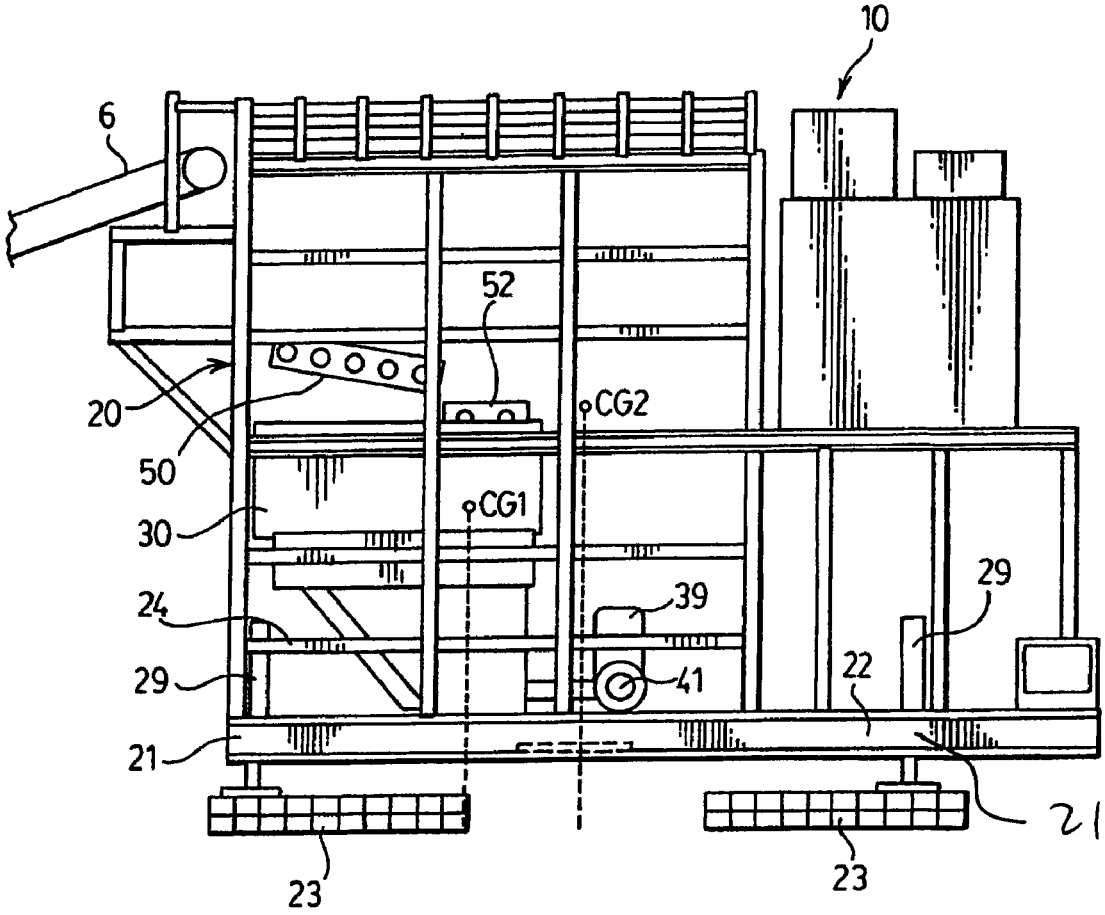
FIG. 2 is a schematic side elevational view of the slurry apparatus of FIG. 1, showing the stationary and operating centres of gravity of the apparatus in a preferred embodiment of the invention.
Figure 3:
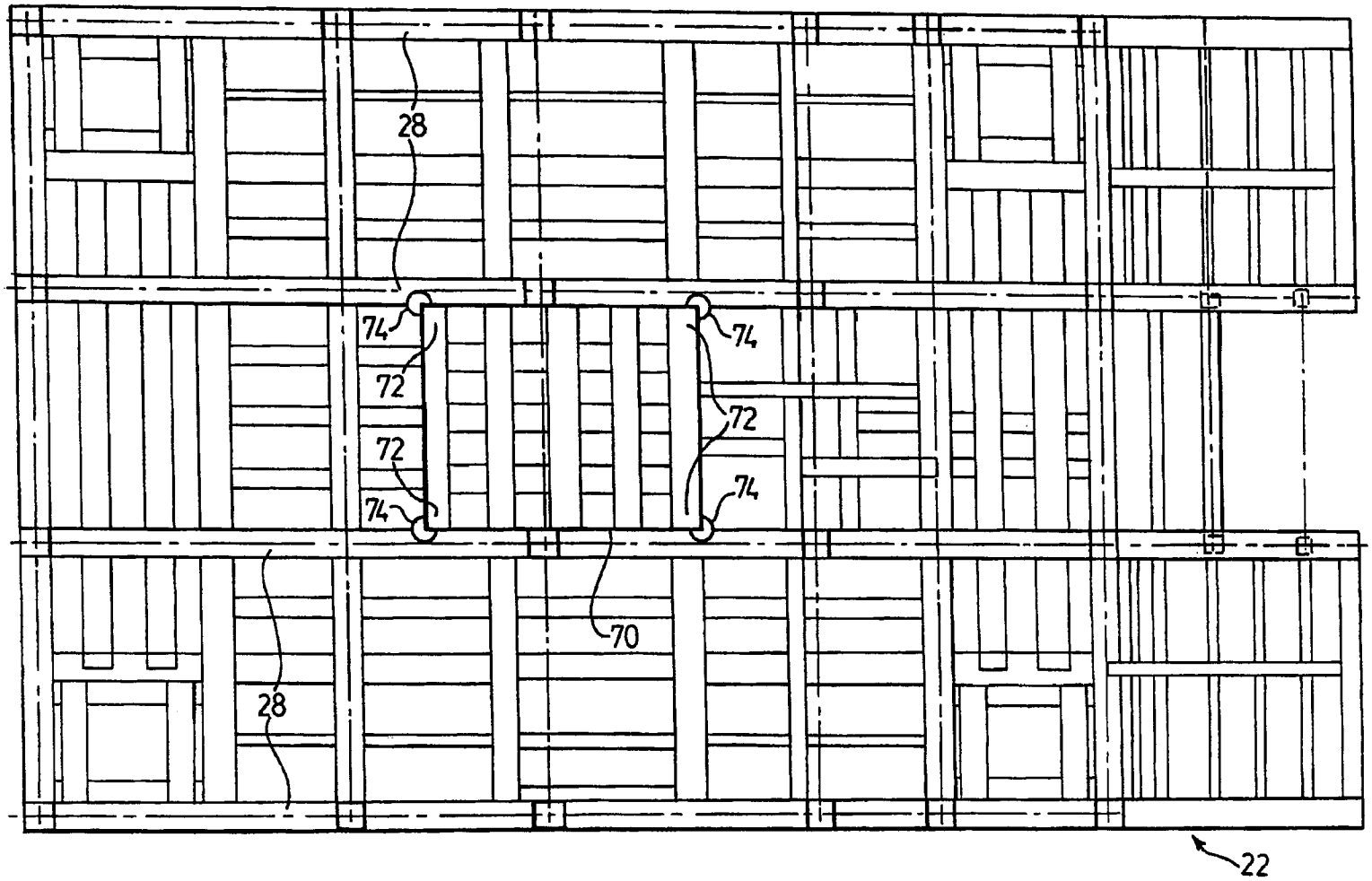
FIG. 3 is a schematic top plan view of the base of the frame in the slurry apparatus of FIG. 1.

In the operating mode, ore is fed to the comminuting apparatus 50 in any desired fashion, for example via a transfer conveyor 6 as shown in FIGS. 1 and 2. Preferably the transfer conveyor 6 is freestanding and not connected to the slurry apparatus 10, but suspended in communication with the slurry apparatus 10. The ore is processed by the comminuting apparatus 50, preferably to reduce the particle size of the entire inflow of ore to a maximum of 2" to 2½" (although larger ore sizes can also be processed). The comminuting apparatus 50 may include an oversize comminuting component 52 (shown in FIG. 2) to comminute oversized ore and eliminate rejected ore.

The comminuted ore is mixed with water from the water supply 60 and fed into the slurry box 30. A slurry of the consistency desired for hydrotransport is thus created within the slurry box 30. The slurry progresses through the slurry box 30 over the selected retention interval and egresses through the slurry outlet to a hydrotransport pump 39, which in turn feeds the slurry into a hydrotransport outlet 41 to which a line (not shown) is detachably connected for transport to an extraction facility (not shown). The hydrotransport line is detachable from the hydro transport outlet 41 to allow for periodic movement of the slurry apparatus 10 to a new site as the mine face moves away from the slurry apparatus 10.

The electrical supplies including all power lines (and optionally telecommunications cables) are preferably contained in a power cable that detachably connects to a local connection (not shown) on the slurry facility 10, which may for example be adjacent to the transformers 9, to facilitate easy connection and disconnection of all electrical systems to a standard power source remote to the movable facility 10.

Preferably the electrical power system is grounded via cable to a local transformer station or platform, rather than directly into the ground, either via the power cable or via a separate grounding cable, to facilitate detachment and reattachment of the ground connection during the relocation procedure. Similarly, water supplies and connections to fluid outlets (for example emergency pond outlet 45) are not welded but are instead detachably coupled via bolted flanges, quick-connect couplings or other suitable detachable connections as desired to facilitate detachment and reattachment during the relocation procedure.

When it is desired to move the slurry apparatus 10 to a new location, the transfer conveyor 6 is deactivated to discontinue the ore flow, and the slurry box 30 is emptied and flushed. Preferably the slurry apparatus 10 includes a cold water supply 43 for use in flushing the slurry apparatus (and in case of emergency; an emergency outlet 45 is also preferably provided for directing contaminated water to a nearby emergency pond if needed). When the slurry box 30 has been completely emptied and flushed, the hydrotransport line (not shown) is disconnected from hydrotransport outlet 41.

All electrical and water supplies are disconnected from the apparatus 10. Once all water supplies and electrical supplies have been disconnected, the slurry apparatus 10 is ready to be moved to a new location.

Figure 4:
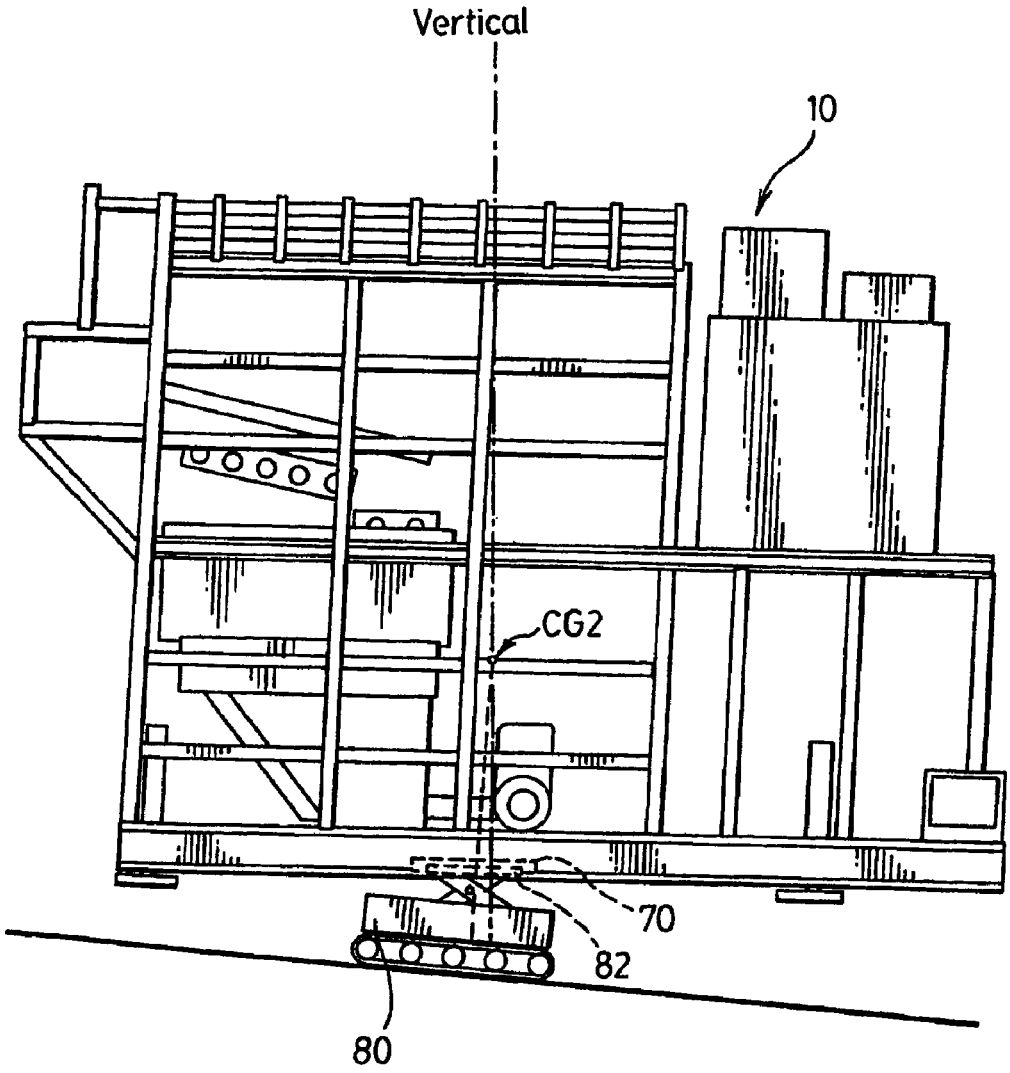
FIG. 4 is a schematic side elevational view showing the apparatus of FIG. 1 being moved on an incline.

A path to the new location is prepared, for example by compacting and laying down a suitable bed of gravel, if necessary. The new location is surveyed to ensure it is level (using gravel if necessary to level the site), and in the embodiment illustrated in FIGS. 1 and 2 crane mats are laid optionally covered by metal sheeting (not shown) to avoid point-loading the crane mats 23. In this embodiment hydraulic jacks 29 are provided generally under the first set of spaced apart support points, supported on the crane mats 23. The jacks 29 are actuated, either in unison or individually in increments, to raise the frame 20 to a height that will allow a moving device 80 such as a Lampson Crawler, with its hydraulic lifting platform 82 in retracted mode, to be driven beneath the base 22 of the frame 20 and positioned under the lifting region 70 using locator tabs 74 (shown in FIG. 3) as a guide to position the hydraulic lifting platform 82. The hydraulic lifting platform 82 is raised, lifting the entire frame 20. When the frame 20 has been raised to support the frame the hydraulic jacks 29 are retracted (as shown in FIG. 4), the propulsion system in the crawler 80 is engaged and the slurry apparatus 10 is moved toward the new location. Preferably the slurry apparatus 10 comprises on-board levels (not shown) at locations visible from the exterior of the apparatus 10, and/or a water level comprising a flexible tube filled with water and extending across the entire frame 20 (not shown), which are carefully monitored by operators to ensure that the facility 10 remains level within the tolerances permitted by the second set of spaced apart support points 72 (as described below).

As illustrated in FIG. 4 the slurry apparatus 10 may be tilted, preferably up to or potentially more than 8° from the vertical, while maintaining the center of gravity in moving mode CG2 over the lifting region 70. This allows the slurry apparatus 10 to be moved up or down a grade, and to tolerate variations of the ground surface. The hydraulic lifting platform 82 on the Lampson Crawler also has the ability to lift differentially, and thus compensate to some extent for the angle of a grade as shown in FIG. 4. However, the slurry apparatus 10 itself may be tilted up to the point where the center of gravity CG2 reaches the periphery of the lifting region 70, beyond which the apparatus 10 will become unstable.

When the new site is reached the hydraulic jacks 29 are extended to support the frame on the crane mats 23 which have been placed on the ground beneath the first set of support points 21, the hydraulic lifting platform 82 is lowered and the Lampson Crawler is driven away from the site. The slurry facility 10 is fully supported by the first set of spaced apart support points 21, and can be returned to the operating mode by extending (from the previous site) and reconnecting the hydrotransport line and all electrical and water supplies. An ore feeder such as a transfer conveyor is positioned in communication with the comminuting apparatus 50, and operation of the slurry facility 10 is resumed. When the slurry box 30 is once again filled with slurry, the center of gravity will shift from CG2 back to CG1, shown in FIG. 2.

Figure 5:
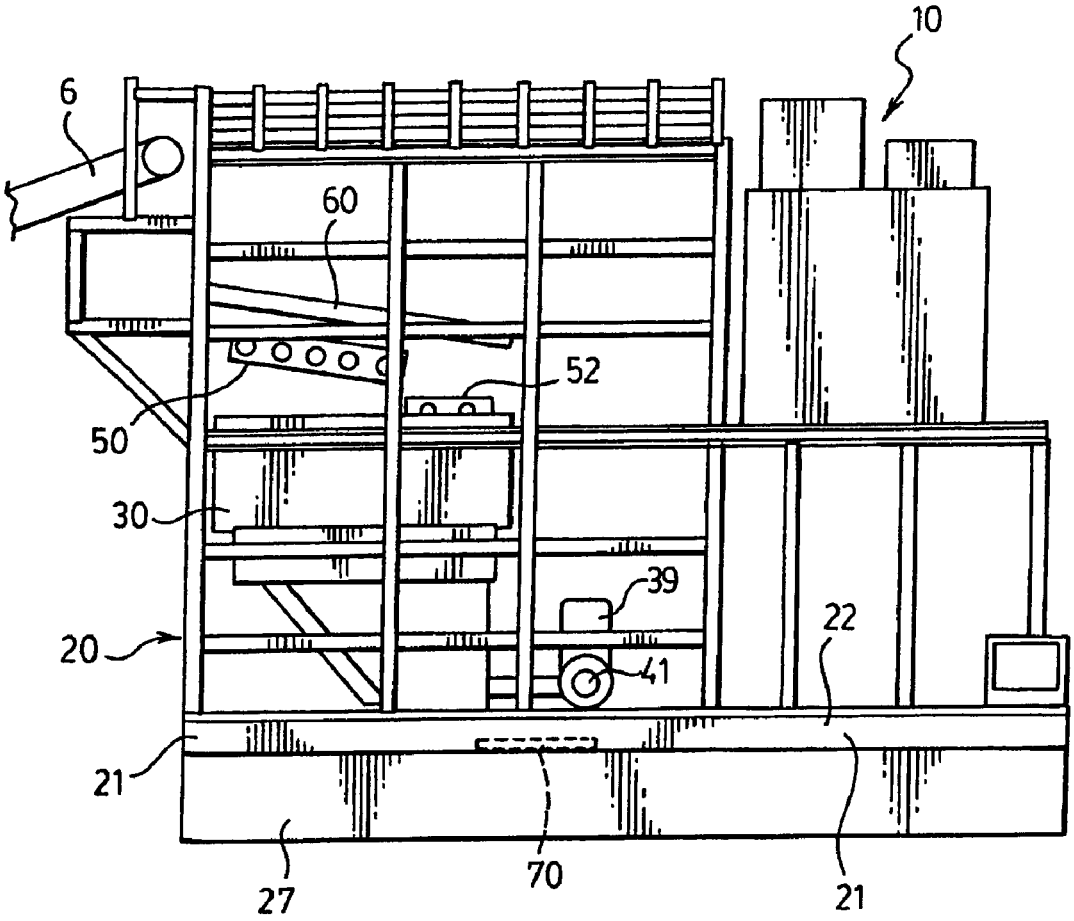
FIG. 5 is a schematic side elevational view of a further embodiment of the slurry apparatus having pontoons.

In a further embodiment of the apparatus illustrated in FIG. 5, the frame 20 is provided with pontoons 27 onto which the frame 20 is set instead of crane mats 23. FIGS. 5*a* to 5*k* are exemplary illustrations showing the interaction of the crawler 80 with the frame 20 and pontoons 27. The illustrations omit the other components of the facility 10 for purposes of clarity of illustration only. This reduces the steps required to both lift the slurry apparatus 10 and to prepare the new relocation site. This also has the advantage of adding weight to the bottom of the frame 20, lowering the centres of gravity CG1 and CG2. The operation of relocating this embodiment is illustrated in FIGS. 5*a* to 5*k*.

Figure 5A:
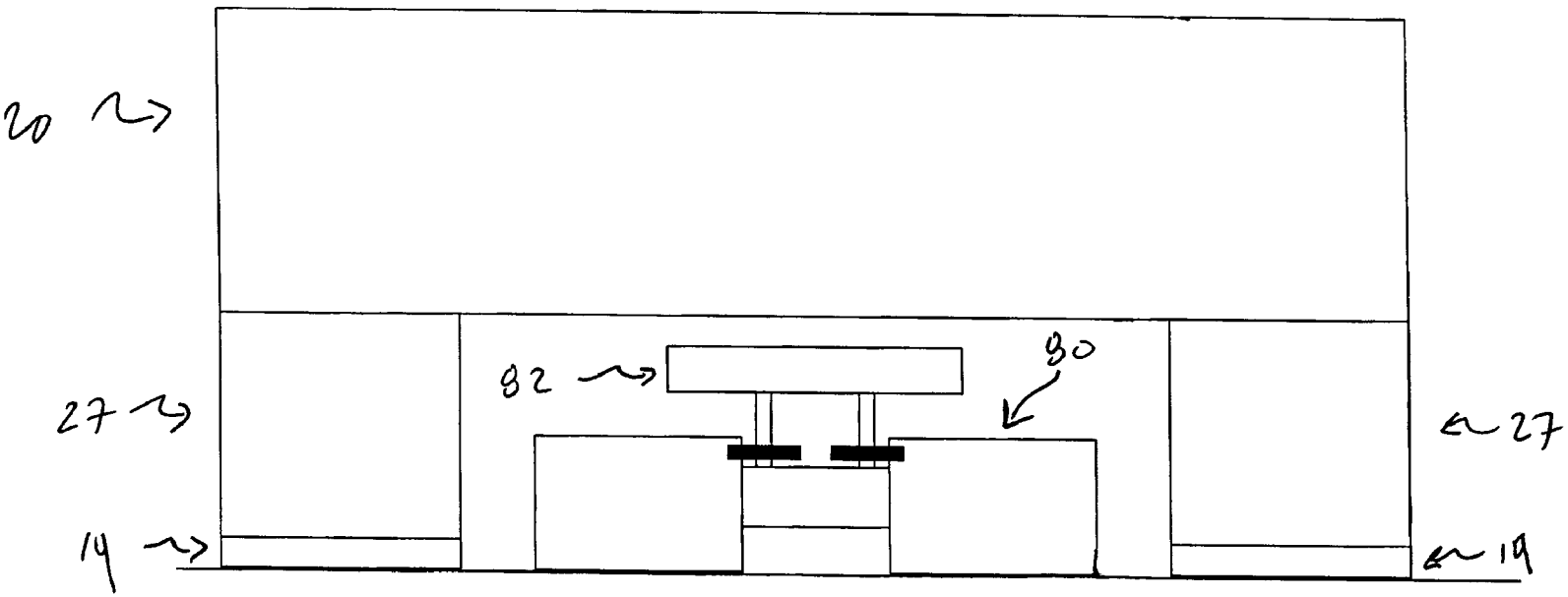
FIG. 5*a* to 5*k* are schematic side view elevations illustrating the base of the frame of the apparatus being relocated.
Figure 6:
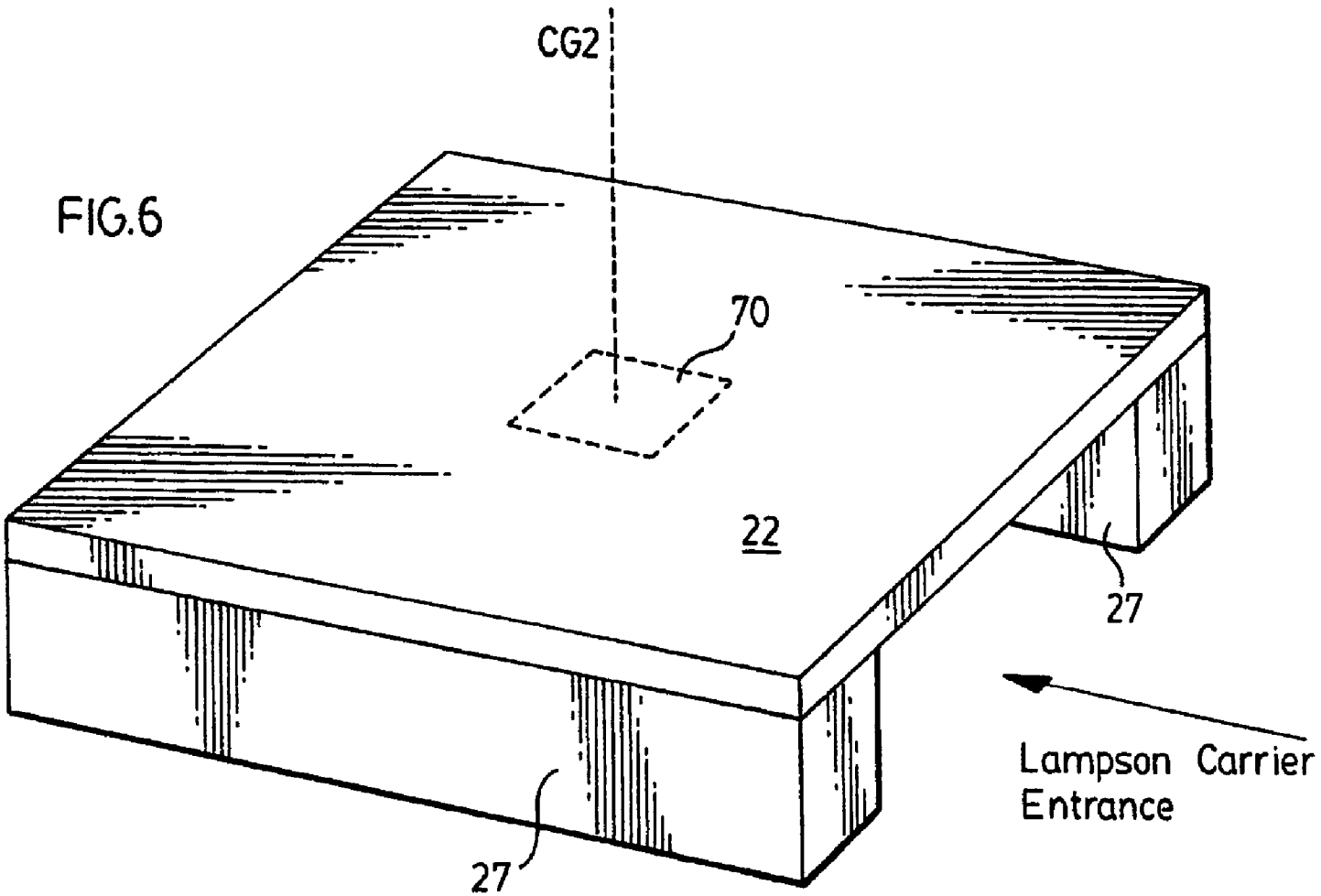
FIG. 6 is a schematic perspective view of the base of the frame in the slurry apparatus of FIG. 5.

In FIG. 5*a*, an elevation schematic, a crawler 80 has moved into position beneath the facility 10 between the pontoons 27 in preparation for a move. In the embodiment illustrated in FIG. 5*a* pads 19 are shown providing a base for the pontoons 27. Pads 19 are optional, and may be used to provide increased clearance for the crawler 80 to access under the frame 20 without the need to provide pontoons 27 of equivalent height. Reducing the height of the pontoons 27 is useful to provide additional ground clearance from the bottom of the pontoons 27 during a move.

Figure 5B:
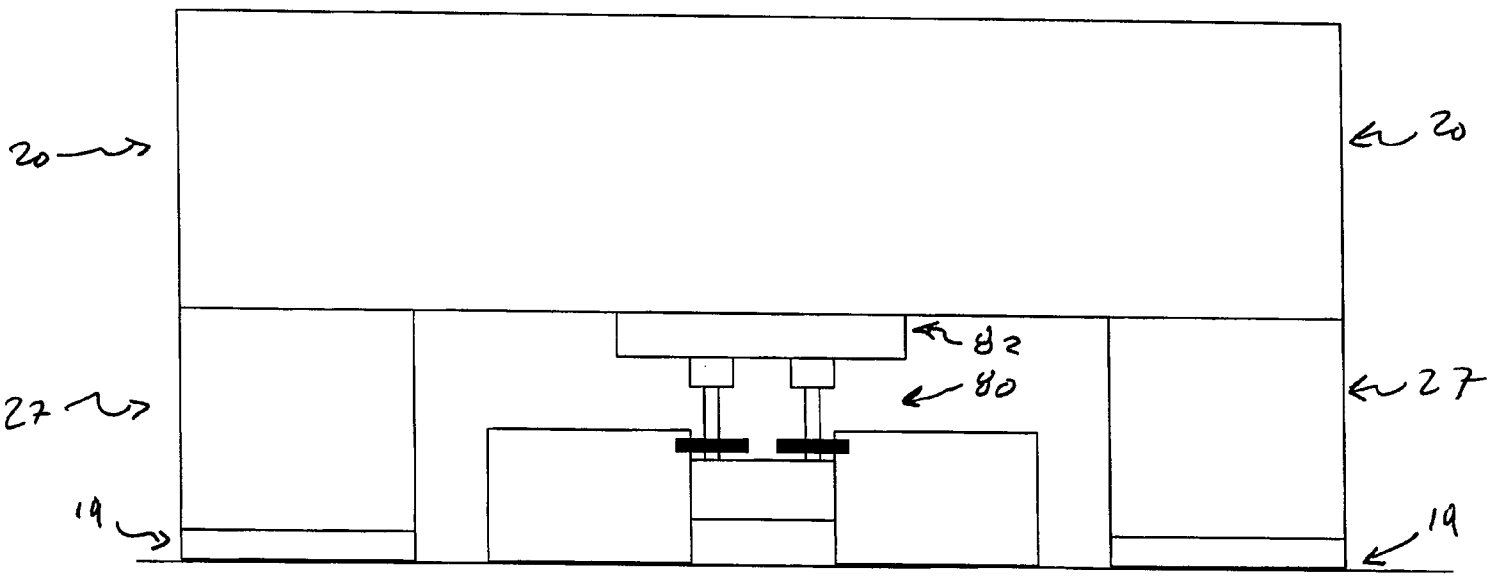
Figure 5C:
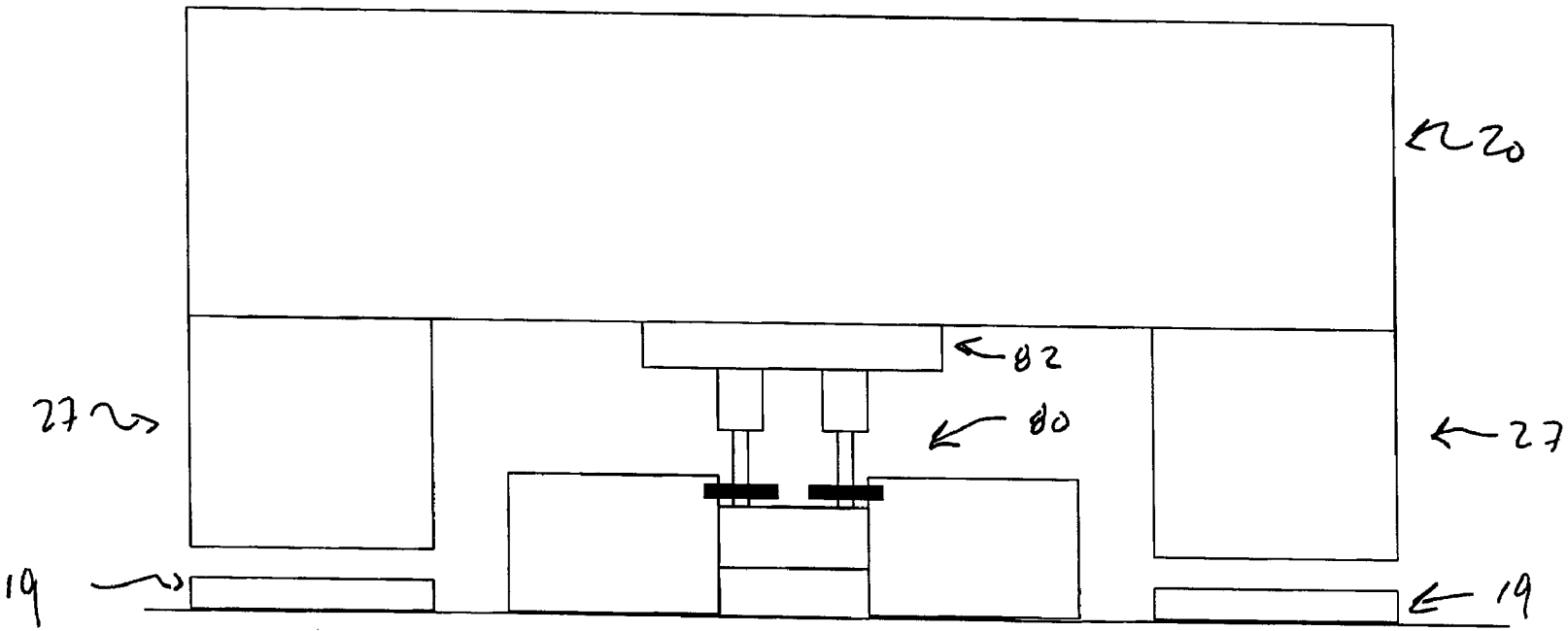
Figure 5D:
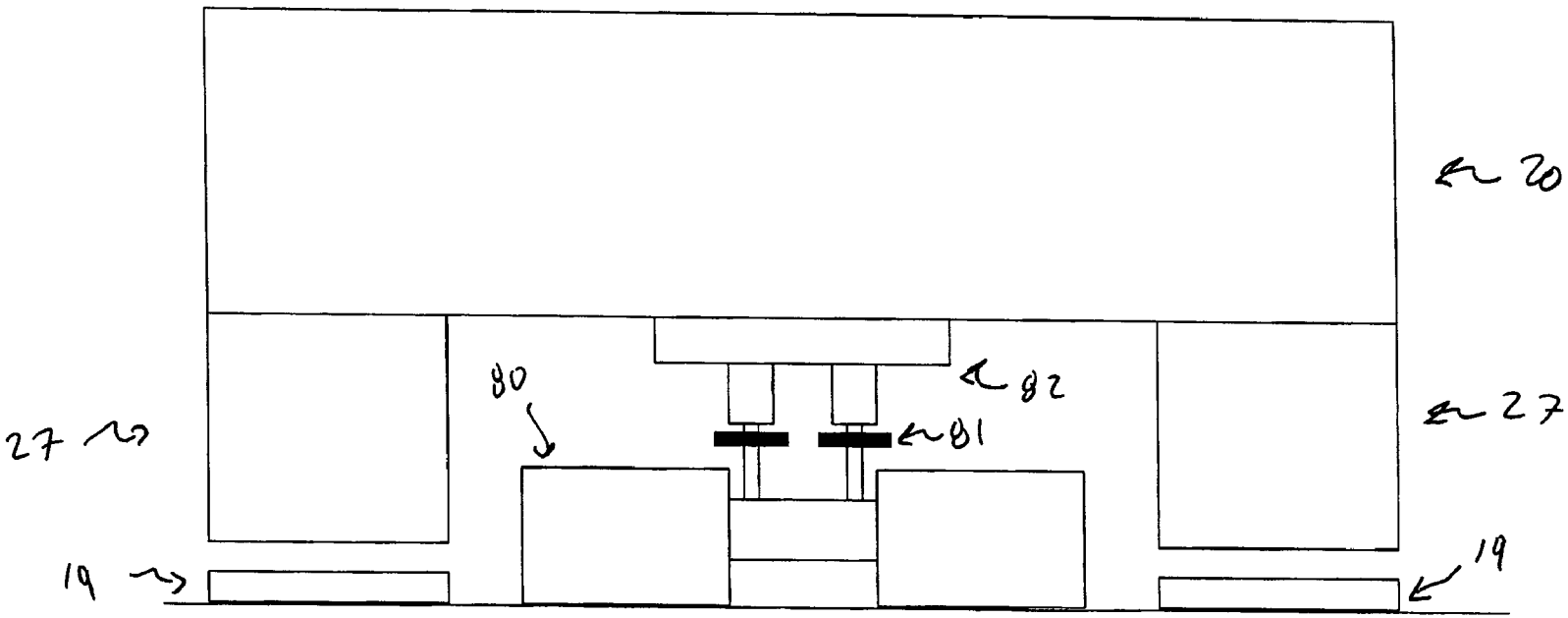
Figure 5E:
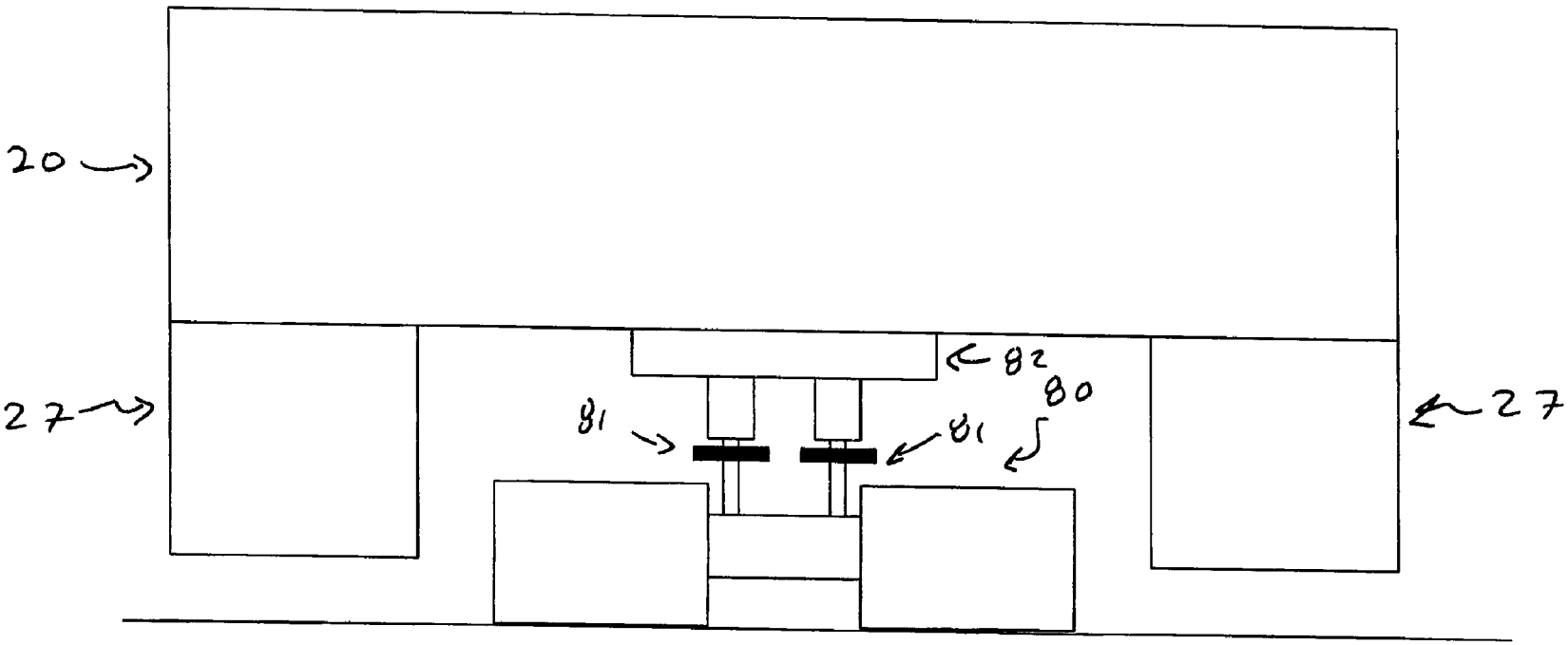
Figure 5F:
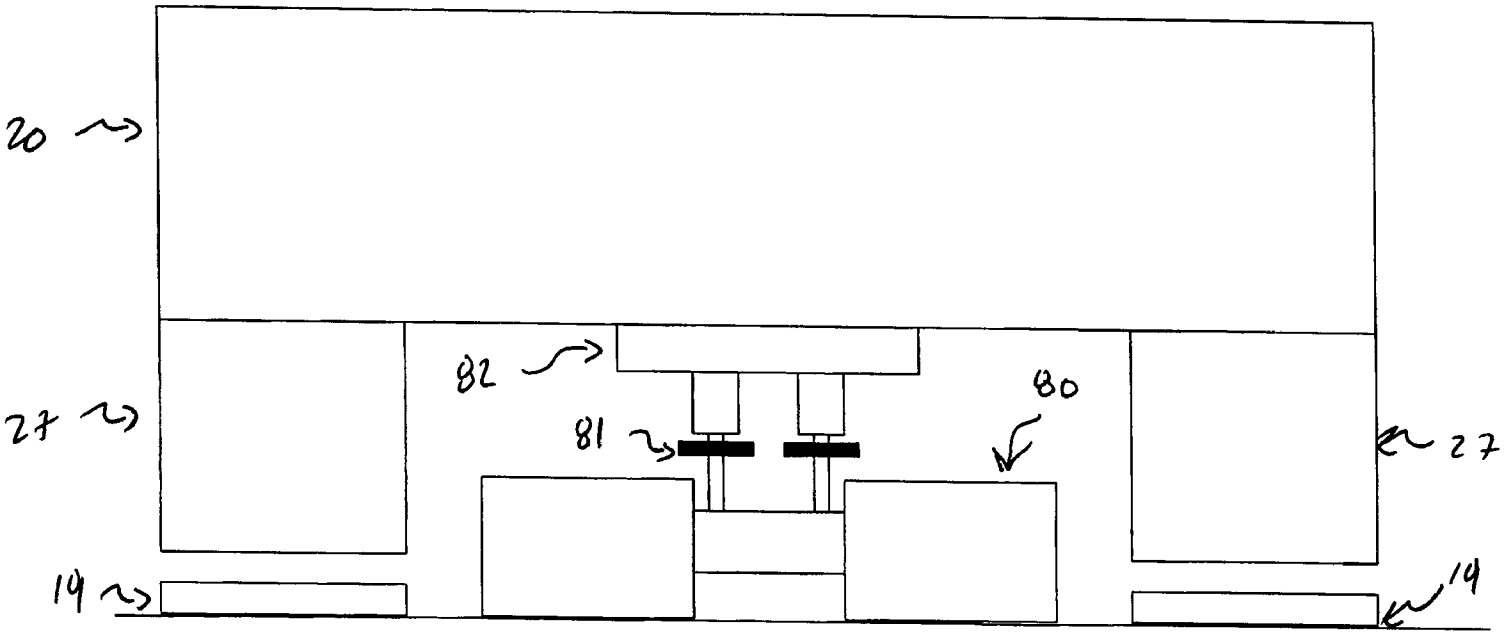
Figure 5G:
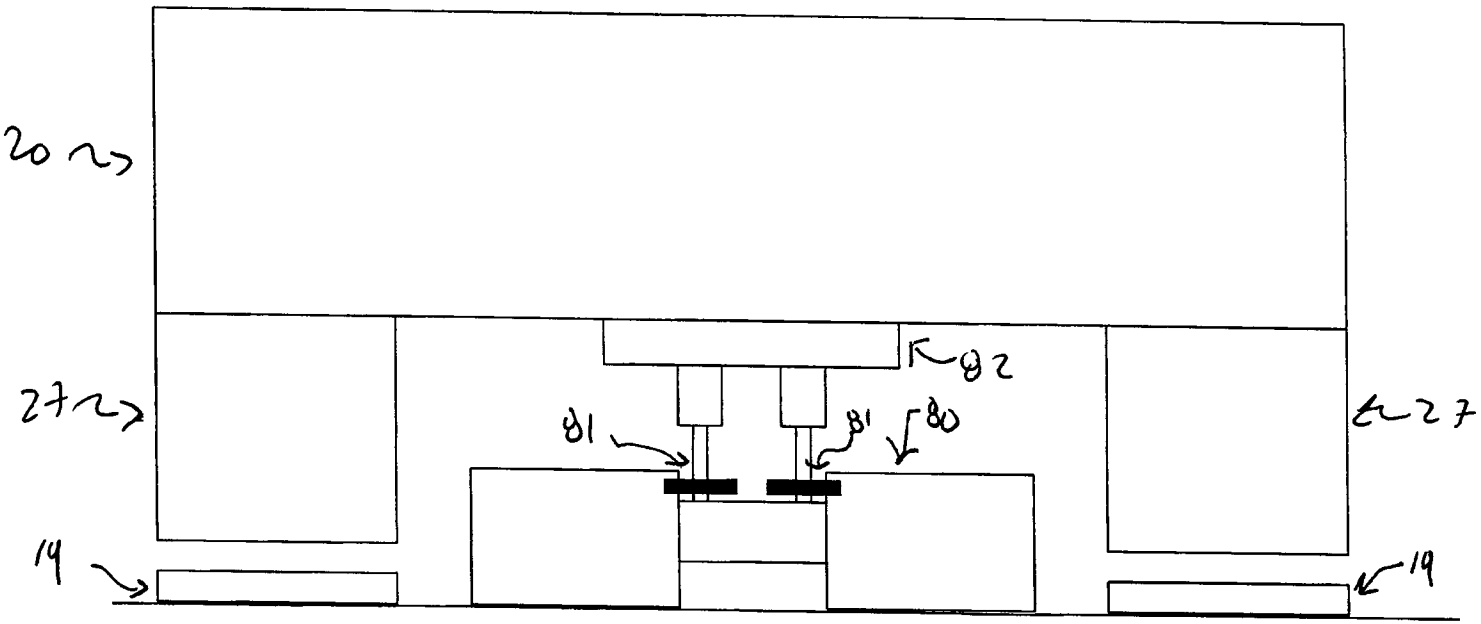
Figure 5H:
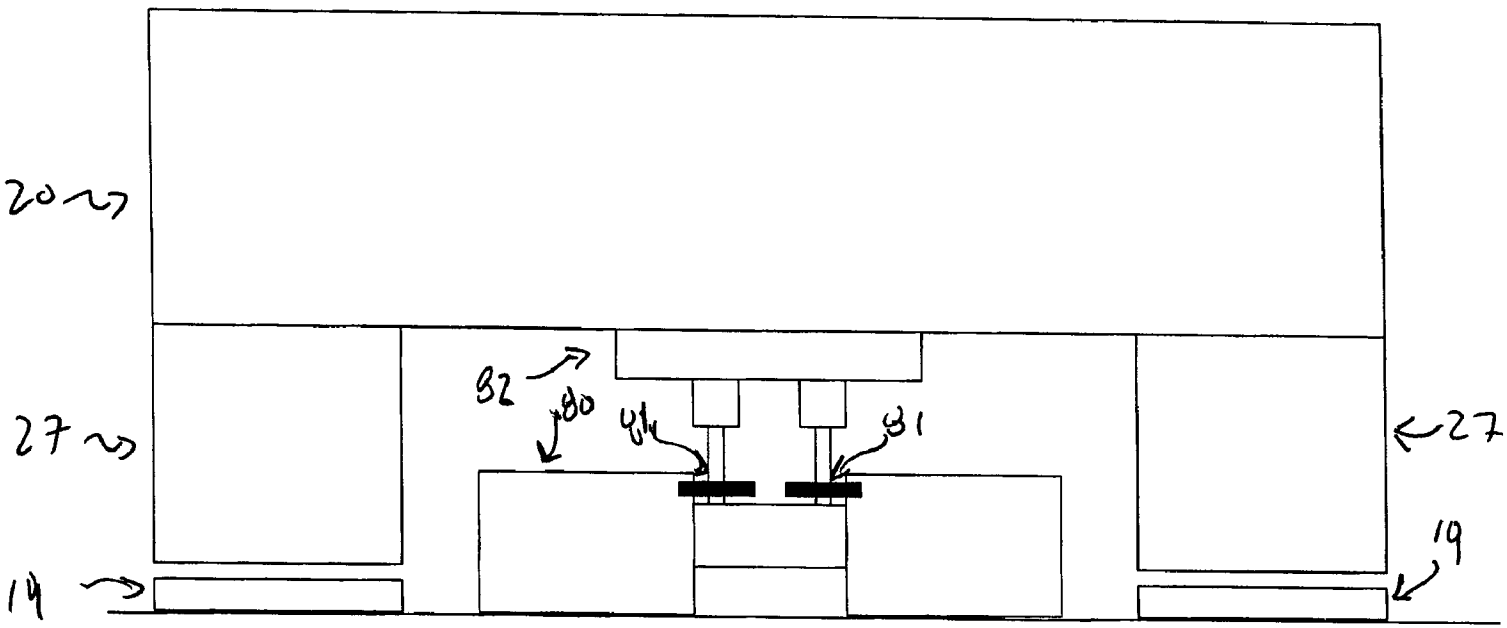
Figure 5I:
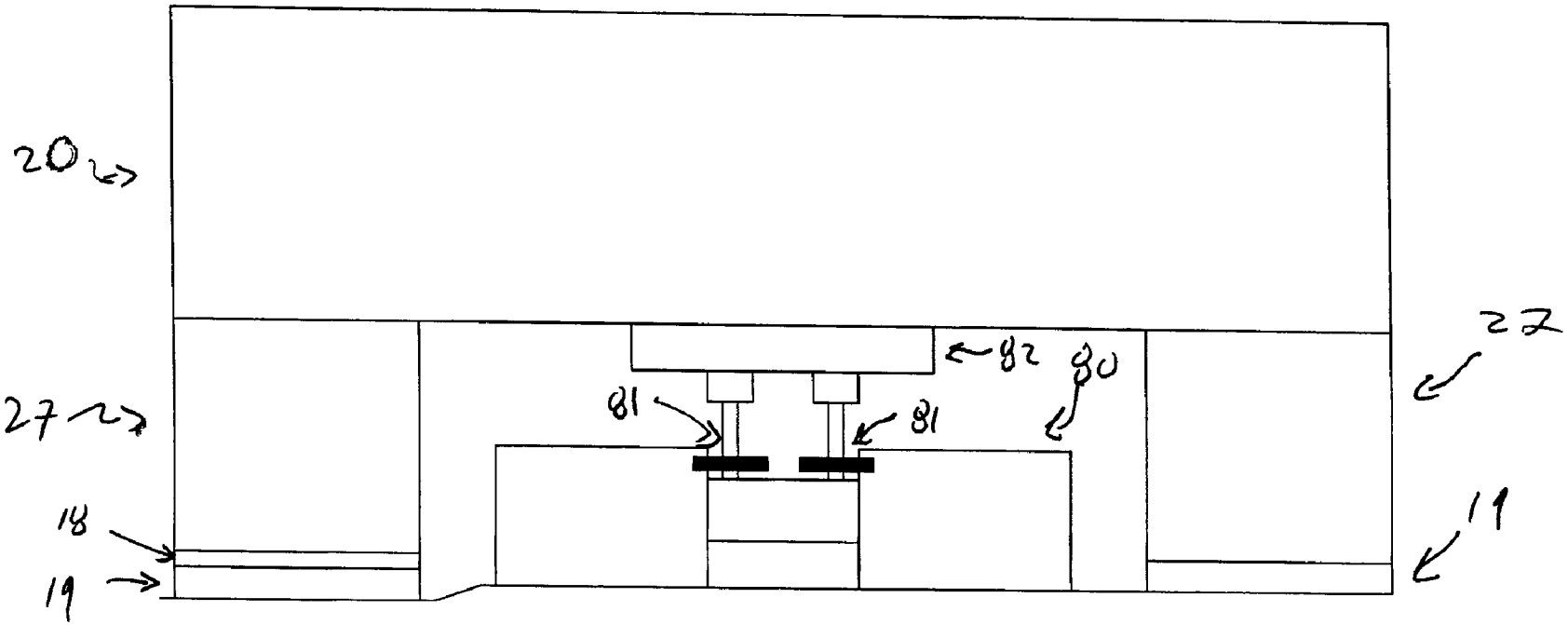
Figure 5J:
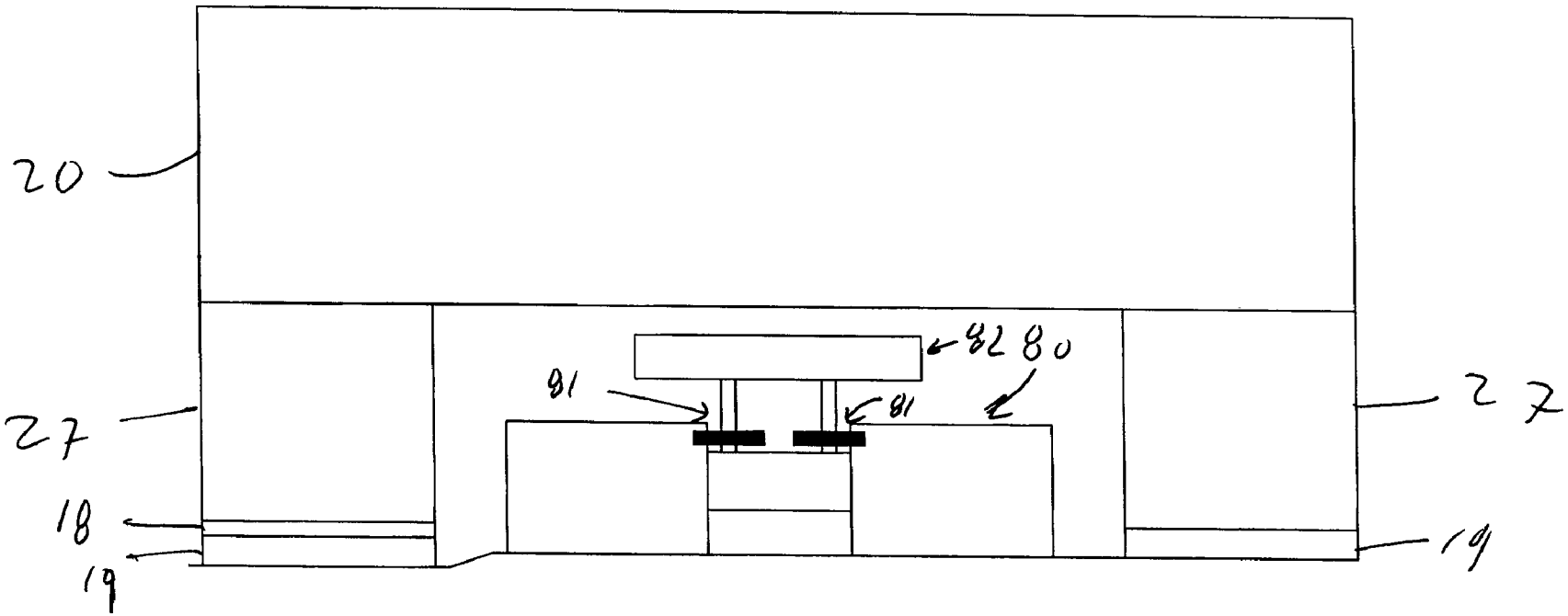
Figure 5K:
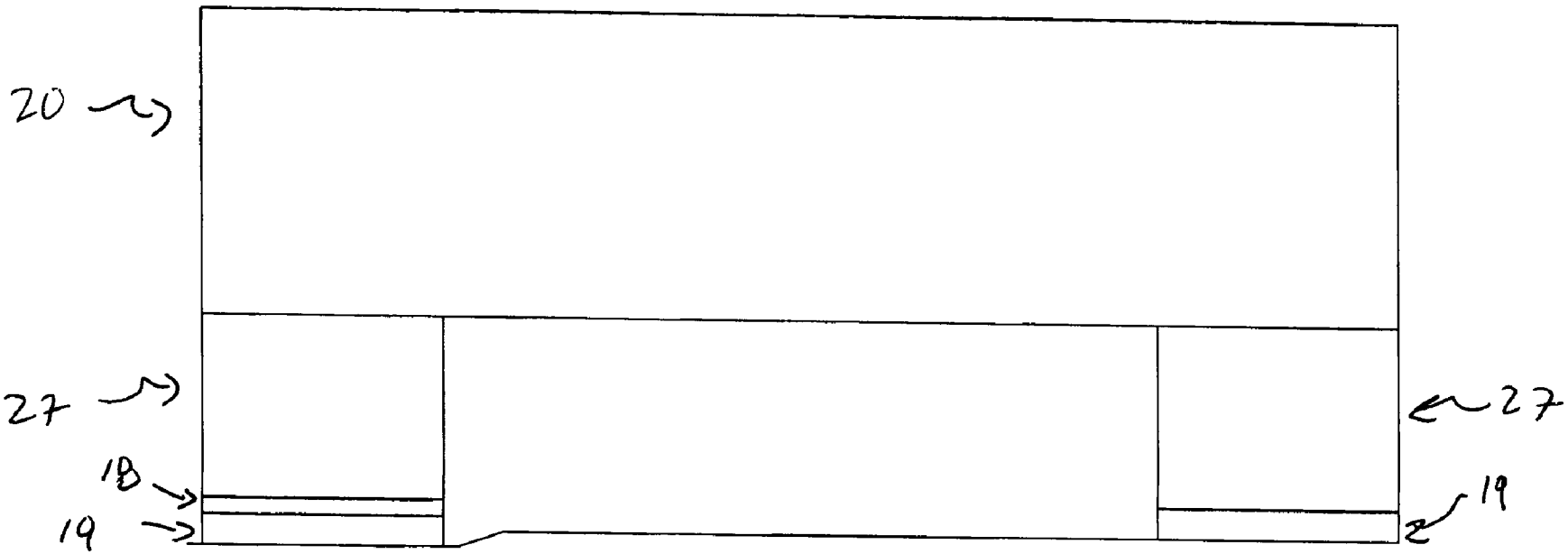

In FIG. 5*b*, an elevation schematic, the crawler 80 has raised the hydraulic lifting platform 82 to engage the frame 20. In FIG. 5*c*, an elevation schematic, the crawler 80 has raised the hydraulic lifting platform 82 to raise the frame 20, lifting the pontoons 27 off the pads 19. In FIG. 5*d*, an elevation schematic, locks 81 have been engaged to lock the hydraulic lifting platform 82 in a raised position in preparation for the move. FIG. 5*e*, an elevation schematic, illustrates the crawler 80 and frame 20 during a move. FIG. 5*f*, an elevation schematic, illustrates the crawler 80 and frame 20 in position over pads 19 in a new location in preparation for lowering the frame 20. FIG. 5*g*, an elevation schematic, illustrates the locks 81 having been released in preparation for the lowering. FIG. 5*h*, an elevation schematic, illustrates the crawler 80 lowering the frame 20 to position the pontoons 27 on the pads 19. FIG. 5*i*, an elevation schematic, illustrates the crawler having lowered the frame and pontoons onto the pads 19. In the example of FIG. 5*i*, a spacer 18 has been positioned between one of the pads 19 and the pontoon 27 to level the frame 20 when positioned on uneven terrain. FIG. 5*j*, an elevation schematic, illustrates the crawler 80 lowering the hydraulic lifting platform 82 in preparation for departure. FIG. 5*k*, an elevation schematic, illustrates the frame 20 and pontoons 27 in place after the crawler 80 has departed.

FIGS. 7 to 10 illustrate alternative embodiments of a comminuting apparatus/hopper arrangement according to the invention.

Figure 7:
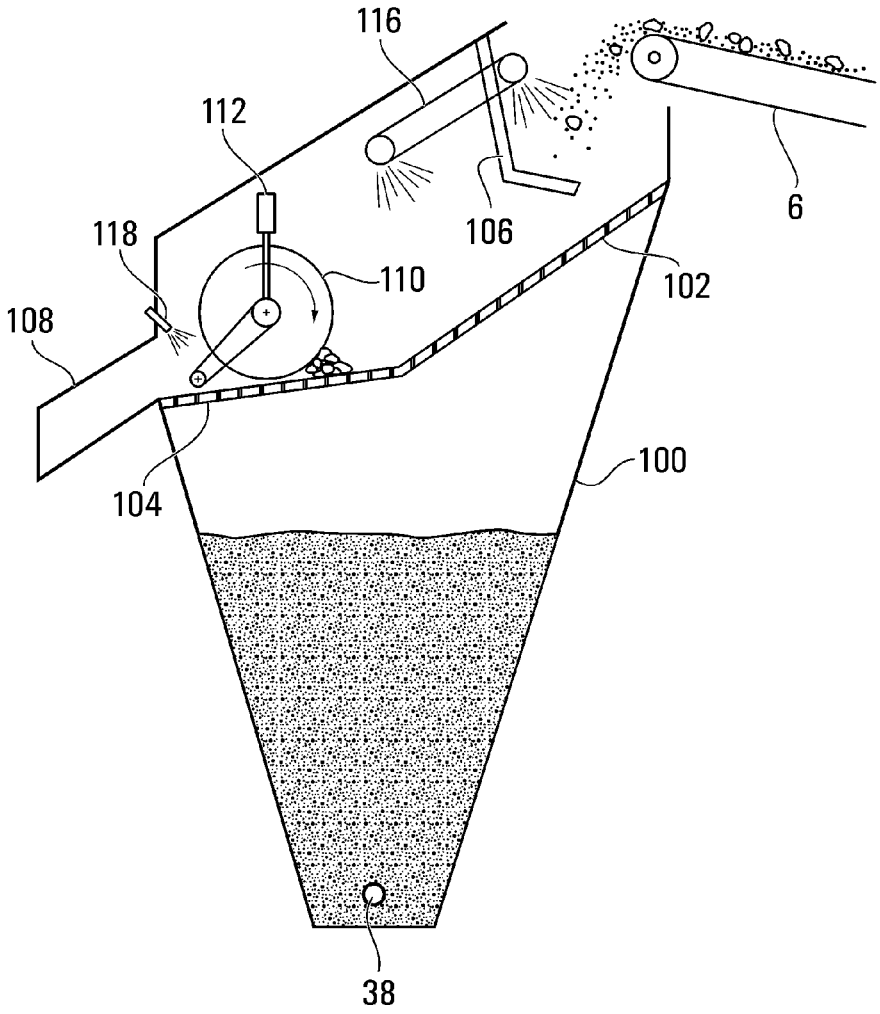
FIG. 7 is a schematic perspective view of a comminuting apparatus/hopper arrangement according to a further embodiment of the invention.

The embodiment illustrated in FIG. 7 provides a slurry box 100 having an open top with staged slopes covered by a screening device, and a slurry box outlet 38 near the bottom of the slurry box 100. The transfer conveyor 6 feeds ore into the portion of the slurry box 100 having a steeper slope, which is covered by a screen, for example a screen plate 102. The ore strikes a guide chute 106 which directs the ore toward a top portion of the slope. A sparge pipe 116 disposed above the screen plate 102 sprays a solvent, for example hot water, onto the raw ore as it slides down the chute 106.

The ore moves down the screen plate 102, which allows ore equal to or smaller than the desired particle size to fall through into the slurry box 100. In the embodiment shown the sparge pipe 116 extends through the guide chute 106 and sprays water onto the ore as the ore moves down the screen plate 102. Oversize ore reaches the portion of the slurry box 100 having a gentler slope, which is covered by a screen plate 104, which is conveniently a separate screen plate, but may alternatively be formed integrally with screen plate 102.

Disposed above the screen plate 104 is a crushing device, in the embodiment shown a crushing wheel 110 suspended from a hydraulic cylinder 112. The crushing wheel 110 rotates in the direction indicated by the arrow, coacting with screen plate 104 to size oversized ore and force same through the openings in the screen plate 104. The hydraulic cylinder 112 is preferably provided with a pressure sensor (not shown), operatively connected to a control system (not shown) that retracts the cylinder 112 to lift the crushing wheel 110 when the pressure increases to a point that might damage the screen plate 104 or jam the crushing wheel 110, for example if a piece of steel or another uncrushable material is present in the ore.

Any oversized chunks remaining downstream of the crushing wheel 110 are ejected through oversize ejection chute 108. A flush nozzle 118 is optionally provided to flush the area of the screen plate 104 downstream of the crushing wheel 110 with water, driving any remaining sized particles through the screen 104 and keeping the screen 104 clear for oversize ejection.

Figure 8:
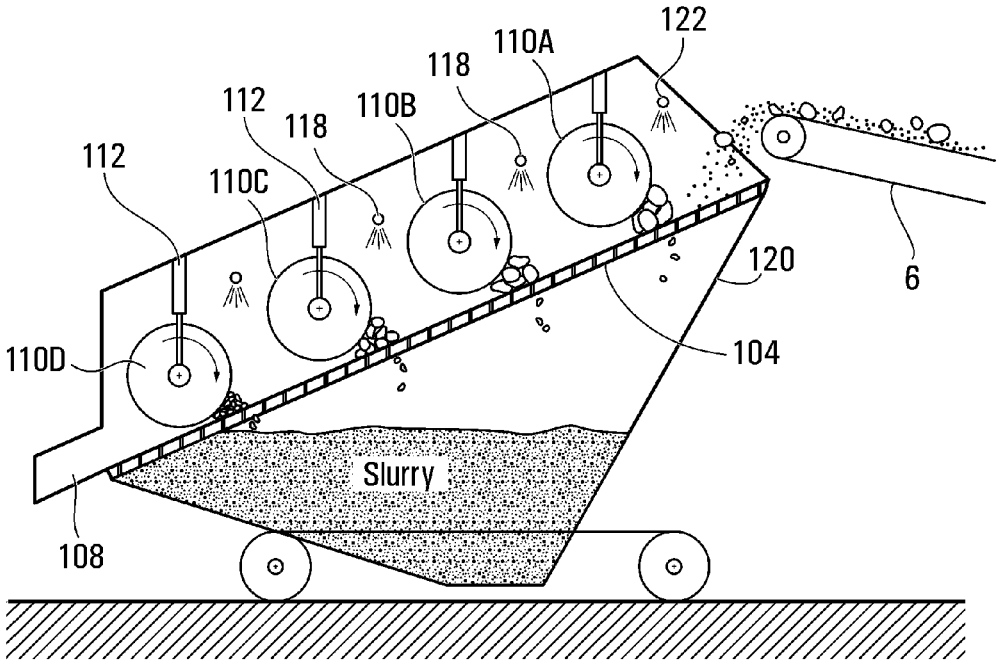
FIG. 8 is a schematic perspective view of a comminuting apparatus/hopper arrangement according to a still further embodiment of the invention.

The embodiment illustrated in FIG. 8 provides a slurry box 120 has an open top with a substantially constant slope covered by a screening device, for example a screen plate 104, and a slurry outlet (not shown) near the bottom of the slurry box 120. In this embodiment the transfer conveyor 6 feeds ore directly onto the top portion of the screen plate 104, and a spray nozzle 122 adds a solvent such as hot water as the ore strikes the screen plate 104.

The ore moves down the screen plate 104, which allows ore equal to or smaller than the desired particle size to fall through into the slurry box 120. Disposed above the screen plate 104 is a crushing device, in the embodiment shown a plurality of crushing wheels 110 each suspended from a hydraulic cylinder 112. The crushing wheels 110 rotate in the direction indicated by the arrows, each coacting with screen plate 104 to size oversized ore and force same through the openings in the screen plate 104. The hydraulic cylinders 112 are each preferably provided with a pressure sensor (not shown), operatively connected to a control system (not shown) that retracts the cylinder 112 to lift a particular crushing wheel 110 when the pressure increases to a point that might damage the screen plate 104 or jam the crushing wheel 110, for example if a piece of steel or another uncrushable material is present in the ore.

Preferably the distance between the crushing wheels 110 and the screen plate 104 decreases in the downstream direction, providing initially coarse crushing and graduating to finer crushing as the coarser chunks are reduced in size as the ore travels along the screen plate 104. As shown in the embodiment of FIG. 8, the crushing wheels 110*a*, 110*b*, 110*c*, 110*d* preferably progressively crush the ore down to a desired size. By way of example only, where the desired size is 2", the most upstream crushing wheel 110*a* could crush to 8" from the screen plate 104, the next downstream crushing wheel 110*b* could crush to 6" from the screen plate 104, the next downstream crushing wheel 110*c* could crush to 4" from the screen plate 104, and the most downstream crushing wheel 110*d* could crush to the desired size 2" from the screen plate 104. Each crushing wheel 110 also assists in moving oversized the ore along the screen plate 104.

In the embodiment shown a series of sprayers 122 is disposed above the screen plate 104. Preferably one sprayer 122 is disposed in the space between each adjacent pair of crushing wheels 110, to add a solvent such as hot water as the ore strikes the screen 104 by spraying the water onto the ore as the ore moves down the screen plate 102. The sprayers 122 may each comprise a single nozzle having a spread capable of covering the width of the screen plate 104, but preferably comprise sparge pipes each having multiple nozzles disposed transversely across the area over the screen plate 104, for an even distribution of water across the screen plate 104. The sprayers 122 facilitate the movement of ore through the screen plate 104 by flushing sized ore through the openings in the screen plate 104, and facilitate the movement of ore along the screen by helping to avoid oversized ore from clogging the crushing wheels 110. As in the above-described embodiments, the amount of water supplied to the screen plate 104 (in this embodiment the cumulative total of water supplied by the sprayers 122) is carefully controlled to provide the desired density of slurry in the slurry box 120.

Any oversized chunks of ore remaining downstream of the crushing wheels 110 are ejected through oversize ejection chute 108.

Figure 9:
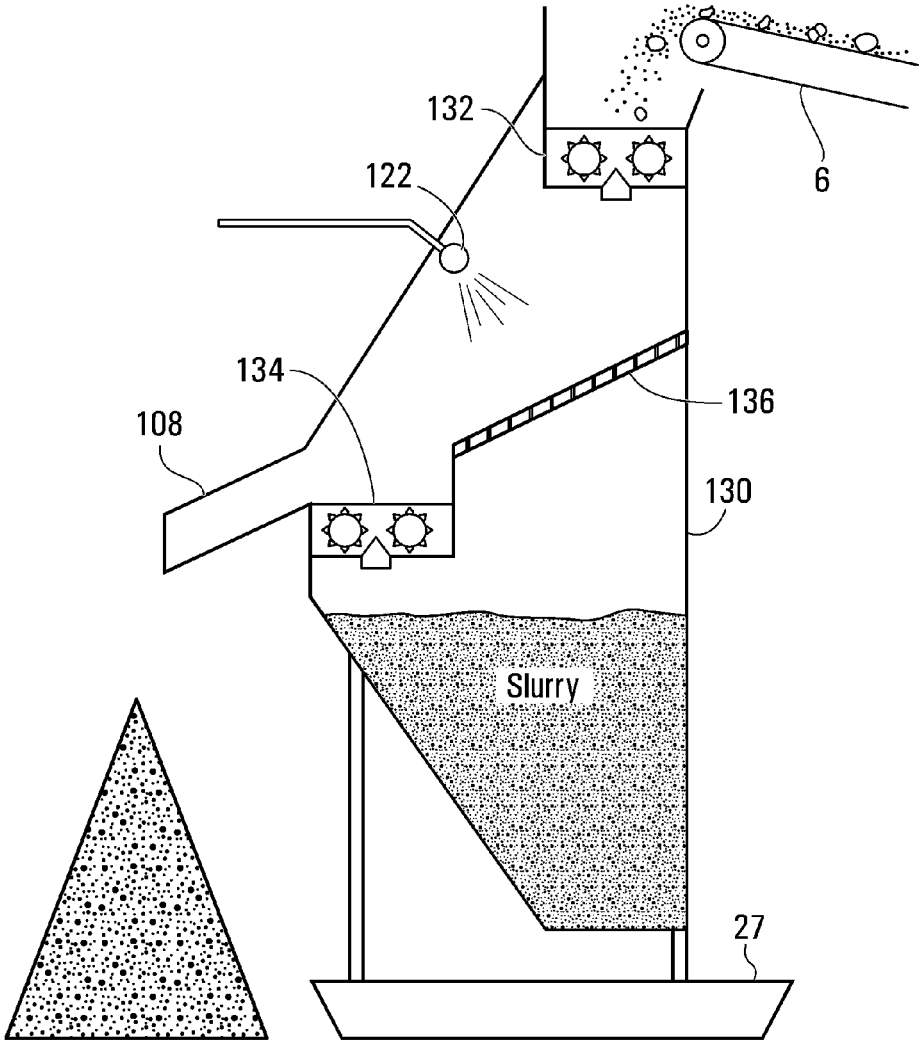
FIG. 9 is a schematic perspective view of a comminuting apparatus/hopper arrangement according to a still further embodiment of the invention.

FIG. 9 illustrates a further embodiment of the invention which provides a comminuting apparatus/hopper configuration having a staged crusher arrangement. A primary crusher 132, for example a sizing roll crusher having at least two spacedly disposed oppositely-rotating elements, is used to comminute ore directly from the feed conveyor 6 to a size capable of being screened by the screen 136. In this embodiment a slurry box 130 has an open top with a substantially constant slope covered by a screening device, for example a vibrating screen 136 or roller screen (not shown), and a slurry outlet (not shown) near the bottom of the slurry box 130. In this embodiment the transfer conveyor 6 feeds ore directly onto the crusher 132, and a sprayer 122 (for example a sparge pipe) adds a solvent such as hot water as the ore strikes and moves down the screen 136.

The ore moves down the screen 136, which allows ore equal to or smaller than the desired particle size (for example, 2") to fall through into the slurry box 130. Disposed beneath the downstream end of the screen 136 and above the top opening of the slurry box 130 is a secondary crusher 134, for example a sizing roll crusher having at least two spacedly disposed oppositely-rotating elements and preferably sizing the ore to a smaller size than the crusher 132. Oversized ore that falls off the downstream end of the screen 136 is processed by the secondary crusher 134, and further sized to fall into the slurry box 130. Any oversized chunks remaining after sizing by the second crusher 134 are ejected through oversized ejection chute 108.

Figure 10:
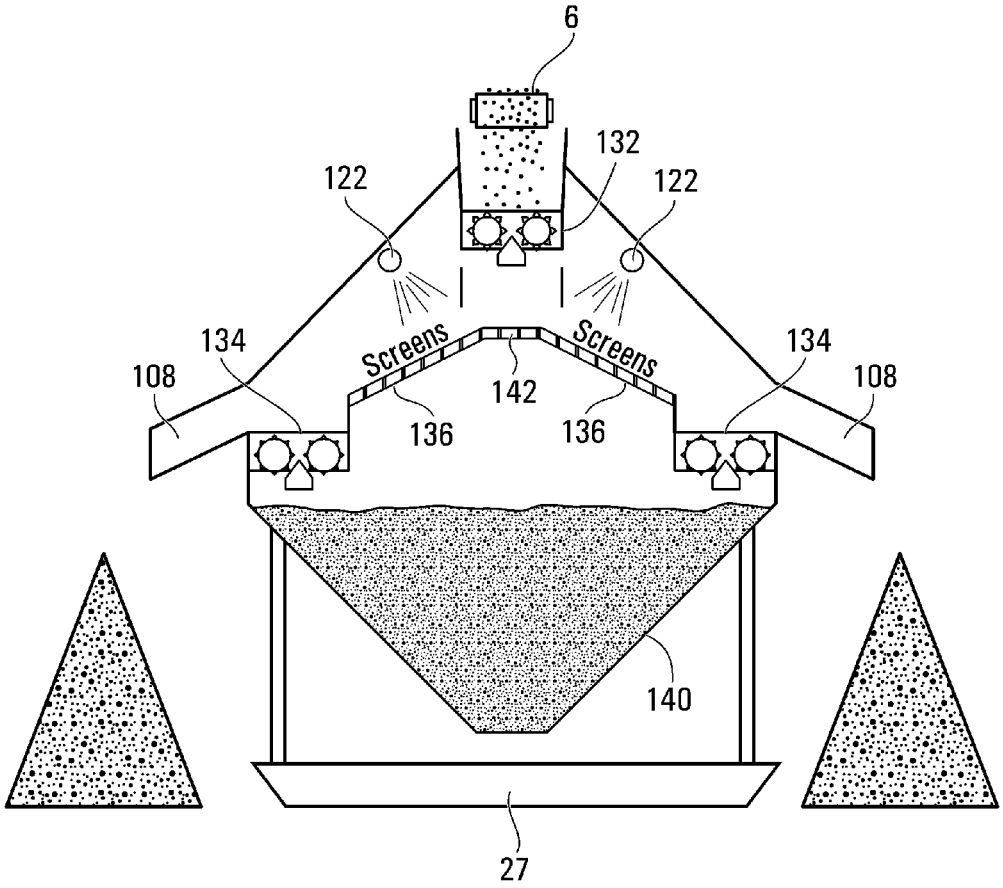
FIG. 10 is a schematic perspective view of a comminuting apparatus/hopper arrangement according to a still further embodiment of the invention.

FIG. 10 illustrates a bi-lateral variation of the embodiment of FIG. 9, which provides primary crusher 132, for example a sizing roll crusher, disposed above a generally horizontal screen 142 generally over the centre of the open top of a slurry box 140.

A sloped screen 136 is disposed on either side of the generally horizontal screen 142 and generally abutting along the common edge (or spaced from the edges of the generally horizontal screen 142 by a distance no greater than the opening size of the screens 136). The two sloped screens 136 are disposed with opposite angles of declination. Disposed beneath the downstream end of each of the sloped screens 136 and above the top opening of the slurry box 140 is a secondary crusher 134, for example a sizing roll crusher. As in the embodiment of FIG. 9. oversized ore that falls off the downstream ends of the screens 136 is processed by the secondary crushers 134, and further sized to fall into the slurry box 140. Any oversized chunks remaining after sizing by the second crusher 134 are ejected through oversized ejection chutes 108.

A preferred embodiment of the invention having been thus described by way of example only, it will be appreciated that variations and permutations may be made without departing from the invention, as set out in the appended claims. All such variations and permutations are intended to be included within the scope of the invention.

What is claimed is:

1. A slurry apparatus for creating a slurry from oil sand ore, comprising:

a frame, a slurry box supported by the frame, a water supply in communication with the ore or the slurry box, whereby water is mixed with the ore to form a slurry that is retained in the slurry box, a screen plate disposed at an angle relative to the horizontal over an open top of the slurry box, and a crusher disposed above the screen plate, the crusher comprising at least one crushing wheel rotatably mounted a distance from the screen plate such that the at least one crushing wheel coacts with the screen plate to size the ore and force the sized ore through the screen plate.

2. The slurry apparatus of claim 1 comprising a plurality of crushing wheels disposed along the screen plate in a downstream direction.

3. The slurry apparatus of claim 2 wherein the distance between the screen plate and at least some of the crushing wheels decreases in the downstream direction.

4. The slurry apparatus of claim 1 wherein the at least one crushing wheel is mounted so that it can be moved to increase the distance when a pressure between the crushing wheel and the screen plate reaches a selected pressure.

5. The slurry apparatus of claim 1 wherein the screen plate comprises first and second sloped screen plate portions, the first sloped screen plate portion being oriented at a first angle relative to the horizontal and the second sloped screen plate portion being oriented at a second angle relative to the horizontal, wherein the first angle is greater than the second angle.

6. The slurry apparatus of claim 5 wherein the first sloped screen plate portion is proximate an upstream end of the screen plate.

7. The slurry apparatus of claim 6 wherein the crusher comprises a first wheel and wherein the first wheel is disposed above the second sloped screen plate portion and downstream of the first sloped screen plate portion.

8. The slurry apparatus of claim 1 wherein the crusher comprises a first wheel rotatably mounted above the screen plate and spaced apart from the screen plate by at least a first distance, the first wheel being operably configured to exert force on incoming ore that becomes disposed between the first wheel and the screen plate by the first wheel pushing at least some of the incoming ore against the screen plate and pushing at least some of the incoming ore along the screen plate toward a downstream end of the screen plate, to cause at least a first portion of the incoming ore to be reduced into particles sufficiently small to pass through openings in the screen plate.

9. The slurry apparatus of claim 8 wherein the crusher further comprises a second wheel rotatably mounted above the screen plate and spaced apart from the screen plate by at least a second distance, the second wheel being disposed downstream of the first wheel and configured to exert force on incoming ore that arrives from a downstream side of the first wheel and becomes disposed between the second wheel and the screen plate, wherein the second wheel is configured to push at least some of the incoming ore against the screen plate and to push at least some of the incoming ore toward a downstream end of the screen plate, to cause at least a second portion of the incoming ore to be reduced into particles sufficiently small to pass through the openings in the screen plate.

10. The slurry apparatus of claim 9 wherein the first distance is greater than the second distance.

11. The slurry apparatus of claim 10 wherein the second distance is approximately equal in size to the openings in the screen plate.

12. The slurry apparatus of claim 9 wherein at least one of the first or second wheels is configured to retract away from the screen plate in response to a signal from a pressure sensor indicating that a pressure exceeding a maximum allowable pressure has been sensed between the screen plate and said at least one of the first and second wheels.

13. The slurry apparatus of claim 12 further comprising an oversize ejection chute, proximate the downstream end of the screen plate, for ejecting oversize pieces of ore that were unable to be crushed sufficiently by the first and second wheels to pass through the openings of the screen plate into the slurry box.

14. The slurry apparatus of claim 9 further comprising at least one sprayer disposed between the first and second wheels and configured to spray water onto the ore as the ore moves along the screen plate between the first and second wheels.

15. The slurry apparatus of claim 1 further comprising at least one sprayer disposed above the screen plate and configured to spray a solvent onto ore to flush the ore through openings in the screen plate and to facilitate movement of the ore along the screen plate.

16. The slurry apparatus of claim 15 wherein total output of solvent from the at least one sprayer is controlled to provide a desired density of slurry in the slurry box.

17. The slurry apparatus of claim 1 wherein the screen plate has a substantially constant slope.

18. The slurry apparatus of claim 8 wherein the first wheel has a top portion and a bottom portion and wherein the first wheel is operably configured to push ore toward a downstream end of the screen plate using the bottom portion.

19. The slurry apparatus of claim 1 further comprising a guide chute for receiving and guiding incoming ore to a location proximate an upstream end of the screen plate.

20. The slurry apparatus of claim 19 further comprising a sprayer for spraying a solvent onto the incoming ore as it moves through the guide chute.

21. An apparatus operable to create a slurry from an ore supply, the apparatus comprising:

a slurry box operable to hold the slurry, the slurry box having an open top portion for receiving incoming ore from the ore supply;

a water supply operable to supply water for mixing with the incoming ore to form the slurry in the slurry box;

a screen plate disposed over the open top portion of the slurry box and having a plurality of openings for sizing the incoming ore, the screen plate having an upstream end and a downstream end, the screen plate being disposed to receive the incoming ore proximate the upstream end, the screen plate including at least one sloped screen plate portion between the upstream and downstream ends and oriented at an angle relative to the horizontal to facilitate sloped downward movement of the incoming ore along the screen plate toward the downstream end; and a first wheel rotatably mounted above the screen plate and spaced apart from the screen plate by at least a first distance, the first wheel being operably configured to exert force on incoming ore that becomes disposed between the first wheel and the screen plate by the first wheel pushing at least some of the incoming ore against the screen plate and pushing at least some of the incoming ore along the screen plate toward the downstream end of the screen plate, to cause at least a first portion of the incoming ore to be reduced into particles sufficiently small to pass through the openings of the screen plate.

22. An apparatus for creating a slurry from an ore supply, the apparatus comprising:

slurry holding means for holding the slurry, the slurry holding means having slurry receiving means for receiving incoming ore from the ore supply;

water supply means for supplying water to be mixed with the incoming ore to form the slurry held in the slurry holding means;

screening and sizing means for screening the incoming ore and for sizing the incoming ore to a predetermined size, the screening and sizing means being disposed to receive the incoming ore at a top portion of the screening and sizing means, the screening and sizing means being oriented at an angle relative to the horizontal to facilitate sloped downward movement of the incoming ore along the screening and sizing means toward a bottom portion of the screening and sizing means; and rotating crushing means disposed above the screening and sizing means for crushing incoming ore arriving in a space between the rotating crushing means and the screening and sizing means.

* * * * *